US011319116B2

(12) United States Patent
Choi

(10) Patent No.: US 11,319,116 B2
(45) Date of Patent: May 3, 2022

(54) CONTAINER FOR STORING AND DISPENSING A FLOWABLE MATERIAL

(71) Applicant: Viva Healthcare Packaging Limited, One Island South (HK)

(72) Inventor: Alfred Choi, One Island South (HK)

(73) Assignee: VIVA HEALTHCARE PACKAGING LIMITED, Hong Kong (HK)

( * ) Notice: Subject to any disclaimer, the term of this patent is extended or adjusted under 35 U.S.C. 154(b) by 0 days.

(21) Appl. No.: 16/984,199

(22) Filed: Aug. 4, 2020

(65) Prior Publication Data

US 2021/0039837 A1 Feb. 11, 2021

(30) Foreign Application Priority Data

Aug. 6, 2019 (AU) ..... 2019902807
Jun. 23, 2020 (AU) ..... 2020902084

(51) Int. Cl.
*B65D 35/44* (2006.01)
*B65D 35/08* (2006.01)

(52) U.S. Cl.
CPC ..... *B65D 35/44* (2013.01); *B65D 35/08* (2013.01)

(58) Field of Classification Search
CPC .... B65D 35/44; B65D 35/08; B65D 39/0005; B65D 2251/0025; B65D 2251/0093; B65D 2251/1041; B65D 2251/1025; B65D 47/0838
USPC ..... 222/556, 92, 557, 562; 220/254.3–254.6, 220/244
See application file for complete search history.

(56) References Cited

U.S. PATENT DOCUMENTS 5,662,245 A * 9/1997 Grant ..... B29C 45/0081 222/153.07
9,073,673 B2 * 7/2015 Mazurkiewicz ..... B65D 51/249
2005/0242132 A1 * 11/2005 Morini ..... B65D 47/0838 222/556
2007/0145073 A1 * 6/2007 Morini ..... B65D 35/44 222/107
2007/0205177 A1 * 9/2007 Delage ..... B65D 47/0814 215/305
2013/0161344 A1 * 6/2013 Park ..... B65D 35/44 220/810
2014/0284347 A1 * 9/2014 Fracasso ..... B65D 47/0838 220/831

(Continued)

FOREIGN PATENT DOCUMENTS

FR 2707958 * 7/1993
FR 2731983 * 3/1995
WO WO 03/099544 A1 * 12/2003

*Primary Examiner* — Lien M Ngo
(74) *Attorney, Agent, or Firm* — Ostrolenk Faber LLP

(57) ABSTRACT

A container is in the form of an In-Mold Labelled (IML) tube comprises a housing 302 and a lid. The lid comprises a base portion 305 to which a cap portion 307 of the lid is pivotally mounted by a hinge to allow the cap portion 307 to transition between open and closed position. A plug is inserted and attached to at least partially or fully seal an aperture formed at the base portion 305. The plug has at least one orifice 314 functioning as an egress opening through which a flowable material stored in the housing 302 can dispense. The housing 302 and lid are made as a single piece by a single injection moulding process. The plug is more rigid than each of the housing 302 and the lid for allowing the plug to lock with the lid firmly.

18 Claims, 12 Drawing Sheets

(56) References Cited

U.S. PATENT DOCUMENTS

2020/0189809 A1* 6/2020 Moskovich ..... B65D 1/32

* cited by examiner

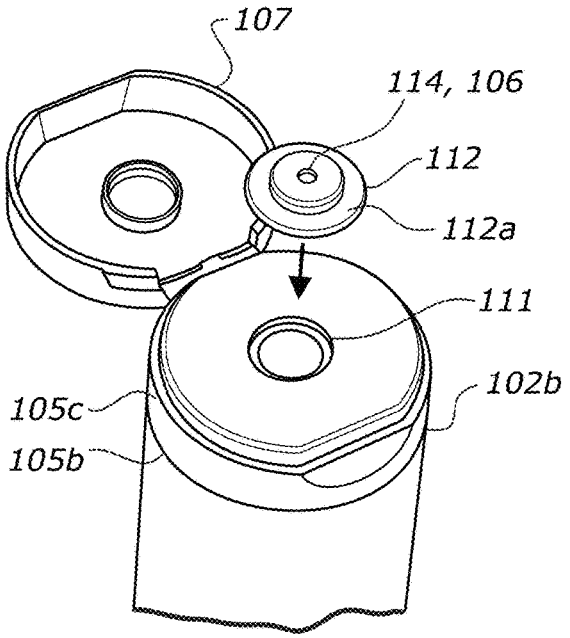
FIG. 5
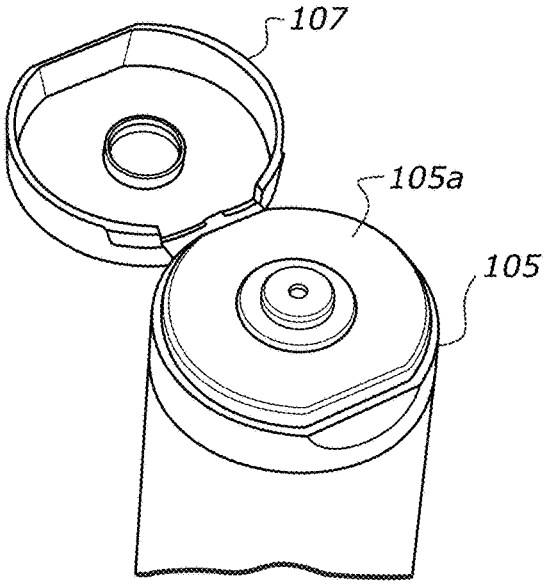
FIG. 6
FIG. 7
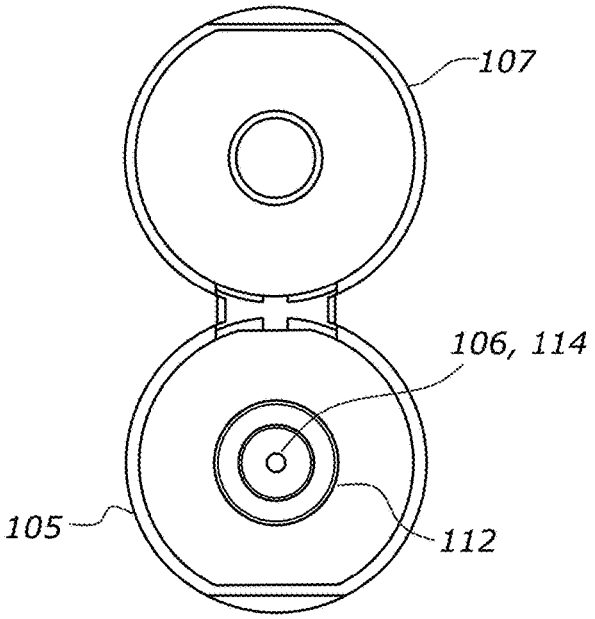

CONTAINER FOR STORING AND DISPENSING A FLOWABLE MATERIAL

CROSS-REFERENCE TO RELATED APPLICATIONS

The present application claims priority to Australian Provisional Patent Application Nos. 2019902807 and 2020902084, filed Aug. 6, 2019 and Jun. 23, 2020, respectively, the contents of which are incorporated herein by reference.

The present invention relates to a container for storing and dispensing a flowable material. More particularly, but not exclusively, it relates to a container for storing and dispensing personal care or a toiletry product.

BACKGROUND OF THE INVENTION

Different types of containers for storing and dispensing flowable materials are known. For example, containers for storing and dispensing personal care items are known. Especially in hotels and other similar temporary residences, guests are usually provided with miniature toiletry bottles containing personal care items such as shampoo, conditioner, body wash, toothpaste, lotion, hair gel, etc.

While previously known containers, may provide several advantageous features, they nevertheless have certain limitations.

For example, size of the egress opening through which the flowable material can be dispensed is usually fixed which means the container can be unsuitable for storing and effectively dispensing the desired volume of different materials having different flow rates or viscosities. From the manufacturer's point of view, it may be useful if the size and/or shape of the egress opening can be varied quickly and conveniently depending upon the customer's requirements.

Containers that are too hard to be squeezed and too brittle to pass standard drop tests used in the industry are not desirable commercially. Also, containers or at least parts (e.g., lids) of such containers that are made from a hard and lower grade plastic material mainly for the cost-saving purposes can easily break apart if they encounter impact few meters of height onto a hard surface such as the floor. Further, such containers cannot pass standard drop tests used in the packaging industry. Also, such hard-plastic containers typically require more plastic to manufacture and therefore the containers can be heavier than required, less environmentally friendly and not sufficiently squeezable for dispensing of the flowable material. Similarly, containers that are too soft are also not desirable because even though such containers may be squeezable, they can easily break apart upon impact during normal use.

Also, if the containers are made from two or more plastic materials and/or parts, then that can lead to cost increase as compared to containers made with one single material and/or made by single injection moulding with one single material.

The above-mentioned problem(s) can also be present in containers of many shape and size that are for storing and dispensing many different types of flowable materials which are not necessarily the toiletry or similar personal care products.

OBJECT OF THE INVENTION

It is an object of the present invention to provide a container for storing and dispensing flowable material which overcomes or at least partially ameliorates some of the abovementioned disadvantages or which at least provides the public with a useful choice.

STATEMENTS OF INVENTION

In a first aspect, the invention broadly resides in a container in a form of an In-Mold Labelled (IML) Tube for storing and dispensing a flowable material, the container comprising:

a housing that is hollow with a closed end, the housing being configured to store at least one flowable material that is to be dispensed from the container; and a lid that is configured to be integrally formed with the housing, the lid comprising a base portion and a cap portion, the cap portion being pivotably mounted to the base portion by a hinge that is a part of the lid;

the base portion of the lid comprises a sealing member in the form of a plug, the plug being or configured to be inserted and attached to the lid to at least partially or fully seal the aperture formed at the base portion of the lid, at least one orifice is formed or configured to be formed on the plug and functions as an egress opening through which at least one flowable material is configured to be dispensed, the lid being configured transition between an open position and a closed position, wherein in the open position the cap portion of the lid is configured to move away from the base portion thereby revealing the egress opening, and when in the closed position the cap portion of the lid is configured to move towards the base position thereby concealing the egress opening, the housing and the lid are made as a single piece by single injection moulding process, the cap portion comprises a plug engagement portion that is configured to engage and interlock with the plug when in the closed position thereby allowing the lid to be securely locked into the closed position while the at least one orifice is clear from engagement with the plug engagement portion.

In a second aspect, the invention broadly resides in a container in the form of an In-Mold Labelled (IML) Tube for storing and dispensing a flowable material, the container comprising:

a housing that is hollow with a closed end, the housing being configured to store at least one flowable material that is to be dispensed from the container; and a lid that is configured to be integrally formed with the housing, the lid comprising a base portion and a cap portion, the cap portion being pivotably mounted to the base portion by a hinge that is a part of the lid;

wherein, the base portion of the lid comprises a sealing member in the form of a plug that is or is configured to be inserted and attached to the lid to at least partially or fully seal an aperture formed at the base portion of the lid, at least one orifice is formed or configured to be formed on the plug and functions as an egress opening through which at least one flowable material is configured to be dispensed, the lid being configured to transition between an open position and a closed position, wherein in the open position the cap portion of the lid is configured to move away from the base portion thereby revealing the egress opening, and when in the closed position the cap portion of the lid is configured to move towards the base position thereby concealing the egress opening, and the housing and the lid are made as a single piece by single injection moulding process, the rigidity of the plug being higher than the rigidity of each of the lid and the housing.

In a third aspect, the invention broadly resides in a plug of a container for storing and dispensing a flowable material, the container comprising:

a housing that is hollow with a closed end, the housing being configured to store at least one flowable material that is to be dispensed from the container; and a lid that is configured to be integrally formed with the housing, the lid comprising a base portion and a cap portion, the cap portion being pivotably mounted to the base portion by a hinge that is a part of the lid;

the lid being configured transition between an open position and a closed position, wherein in the open position the cap portion of the lid is configured to move away from the base portion and when in the closed position the cap portion of the lid is configured to move towards the base position and physically engage with the base position, the housing and the lid are made as a single piece by single injection moulding process, wherein the plug being or is configured to be inserted and attached to the lid to at least partially or fully seal an aperture formed on the base portion of the lid, at least one orifice is formed or configured to be formed on the plug to function as an egress opening through which at least one flowable material stored in the housing is configured to be dispensed, wherein the plug is configured to engage and interlock with a plug engagement portion formed of the cap portion of the lid when the lid is in a closed position thereby allowing the lid to be securely locked into the closed position, when in the closed position the at least one orifice is clear from engagement with the plug engagement portion.

In a fourth aspect, the invention broadly resides in a container for storing and dispensing a flowable material (that is preferably in a fluid form such as a liquid), the container comprising:

a housing that is hollow with a closed end, the housing being configured to store at least one flowable material that is to be dispensed from the container; and a lid that is configured to be integrally formed with the housing, the lid being configured to pivotally move between an open position and a closed position by a hinge that is integrally formed with the lid as a part of the lid so that when in the open position the lid is reveals an egress opening through which at least one flowable material is configured to be dispensed, and when in the closed position the lid conceals the opening, wherein, at least the housing is squeezable by a user's hand and is non-fragile when such squeezing force is applied, and the lid is sufficiently strong for the hinge to function during normal use, and wherein, the housing and the lid are both made as a single piece by single injection moulding of a single polypropylene material.

In a fifth aspect, the invention broadly resides in a container for storing and dispensing a flowable material (that is preferably in a fluid form such as a liquid), the container comprising:

a housing that is hollow with a closed end, the housing being configured to store at least one flowable material that is to be dispensed from the container; and a lid that is configured to be integrally formed with the housing, the lid comprising a base portion and a cap portion, the cap portion being pivotably mounted to the base portion by a hinge;

wherein, the base portion of the lid comprises a plug having at least one orifice that functions as an egress opening through which at least one flowable material is configured to be dispensed, the lid being configured to move between an open position and a closed position, wherein in the open position the lid is configured to reveal the egress opening, and when in the closed position the lid is configured to conceal the egress opening, and the housing, lid and the hinge are made as a single piece by single injection moulding process.

In a sixth aspect, the invention broadly resides in a container in the form of an In-Mold Labelled (IML) Tube that is suitable for storing and dispensing a flowable material (that is preferably in a fluid form such as a liquid), the container comprising:

a housing that is hollow with the closed end, the housing being configured to store at least one flowable material that is to be dispensed from the container; and a lid that is configured to be pivotally moved between an open position and a closed position using a hinge that is formed as part of the lid, wherein when in the open position the lid is configured to reveal an egress opening through which at least one flowable material is configured to be dispensed, and when in the closed position the lid is configured to conceal the egress opening, wherein, the housing and the lid are both made as a single piece by single injection moulding of a construction material.

The feature(s) defined by any one or more of the statements below may apply to any one or more of the above defined aspects and/or statements.

In one embodiment, the rigidity of the plug is higher than the rigidity of each of the lid and the housing.

In one embodiment, the cap portion comprises a plug engagement portion that is configured to engage and interlock with the plug when the lid is in the closed position thereby allowing the lid to be securely locked into the closed position.

In one embodiment, the plug engagement portion is configured to engage and interlock with the plug when the lid is in the closed position while the at least one orifice is clear from engagement or alignment with the plug engagement portion.

In one embodiment, the plug engagement portion and the plug are configured to be engaged together and interlock with each other with a snap fit or snug fit arrangement.

In one embodiment, the plug engagement portion comprises a plug engagement member in the form of a circular rim and the plug comprises a complementary feature in the form of a nipple that is adapted to interlock with the circular rim.

In one embodiment, the plug engagement portion in is in the form of a first plug engagement member and a second plug engagement member which along with their respective centre points are spaced apart from one another, wherein the first and second plug engagement members are configured to engage and interlock respectively with a first complementary feature and a second complementary feature formed on the plug when the lid is in the closed position, wherein the first complementary feature, the second complementary feature and centre points of the first and second complementary features are spaced apart from one another.

In one embodiment, the first plug engagement member is in the form of a circular rim and the first complementary feature is in the form of a nipple on which the at least one orifice is formed or configured to be formed.

In one embodiment, the second plug engagement member is in the form of a pin that is configured to be received by the second complementary feature that is in the form of a recess or a hole.

In one embodiment, the plug comprises a base that is configured to be attached to the lid to seal the aperture, wherein the nipple protrudes upwardly from the base.

In one embodiment, at least the housing is squeezable by a user's hand and is non-fragile when such squeezing force is applied.

In one embodiment, the housing and the lid are made of a construction material that is or comprises polyolefin, preferably thermoplastic polyolefin.

In one embodiment, the housing and the lid are made of a construction material that is or comprises polypropylene.

In one embodiment, the housing and the lid are made of same construction material of same chemical formulation.

In one embodiment, the container is a single use container.

In one embodiment, the housing is substantially tubular in shape with a substantially uniform cross-sectional area/diameter throughout the length of the housing and the housing being configured to extend between a first end and a second end along a longitudinal axis of the container, the first end being the closed end and the lid is integrally formed with the housing at the second end of the housing.

In one embodiment, the housing is substantially annular in cross-section in a plane that is orthogonal to the longitudinal axis of the container.

In one embodiment, the lid is substantially annular in cross-section in a plane that is orthogonal to the longitudinal axis of the container.

In one embodiment, the closed end is shaped to allow the container to stand vertically on a substantially horizontal surface.

In one embodiment, the lid has a uniform wall thickness.

In one embodiment, the housing has a uniform wall thickness.

In one embodiment, the lid and the housing both have a same and uniform wall thickness.

In one embodiment, a top portion of the base portion is substantially flat and comprises the egress opening.

In one embodiment, the aperture is substantially circular.

In one embodiment, an annular ledge is formed inside the aperture.

In one embodiment, the at least one orifice and/or the aperture is sealed by at least one foil.

In one embodiment, the plug is attached or configured to be attached to the lid by sonic welding.

In one embodiment, the plug is from a polymeric material, preferably plastic.

In one embodiment, the plug is made of a polypropylene material.

In one embodiment, the plug is transparent.

In one embodiment, the container is the one as claimed in any one of the preceding claims.

In one embodiment, the housing is integrated with the closure.

In one embodiment, the plug is made out of polypropylene integrated with the lid.

In one embodiment the label is made out of polypropylene.

In one embodiment, the container is an In-Mold Labelled (IML) Tube.

In one embodiment, the external diameter of the housing is less than 50 mm.

In one embodiment, the external diameter of the housing is greater than 40 mm but less than 60 mm.

In one embodiment, the external diameter of the housing is 48.5 mm.

In one embodiment, the external diameter of the lid is less than 50 mm.

In one embodiment, the external diameter of the lid is greater than 40 mm but less than 60 mm.

In one embodiment, the external diameter of the lid is 48.5 mm.

In one embodiment, the closed end is shaped to allow the container to stand vertically on a substantially horizontal surface.

In one embodiment, lid has a uniform wall thickness.

In one embodiment, the housing has a uniform wall thickness.

In one embodiment, the lid and the housing both have a same and uniform wall thickness.

In one embodiment, the wall thickness of the housing and/or the lid is 3 mm or less.

In one embodiment, the wall thickness of the housing and/or the lid is 2 mm.

In one embodiment, the wall thickness of the housing and/or the lid is 1 mm.

In one embodiment, the housing is less than 260 mm in length.

In one embodiment, the housing is between 150 mm and 250 mm in length.

In one embodiment, the housing is 200 mm in length.

In one embodiment, the lid extends less than 30 mm from the housing along the longitudinal axis of the container. In other words, the lid is less than 30 mm in length/height.

In one embodiment, the lid extends between 15 and 25 mm from the housing along the longitudinal axis of the container. In other words, the lid is between 15 and 25 mm in length/height.

In one embodiment, the lid extends 20 mm from the housing along the longitudinal axis of the container. In other words, the lid is 20 mm in length/height.

In one embodiment, the lid comprises a base portion and a cap portion, the cap portion being pivotably mounted to the base portion by the hinge, the base portion being mounted to or integrally formed with the second end of the housing.

In one embodiment, the base portion comprises a top portion and a bottom portion with an annular wall extending between the top portion and the bottom portion, the cap portion being pivotally mounted to the top portion by the hinge and the bottom portion being integrally formed with the housing at the second end of the housing.

In one embodiment, the top portion of the base portion is substantially flat and comprises the egress opening.

In one embodiment, the egress opening is in the form of an aperture.

In one embodiment, the aperture is substantially circular.

In one embodiment, the aperture is configured to be at least partially (preferably fully) sealed with a sealing member.

In one embodiment, the sealing member is a foil.

In one embodiment, the sealing member is a plug.

In one embodiment, the plug comprises a base or an annular base that is configured to be attached to the lid to seal the aperture.

In one embodiment, an annular ledge is formed inside the aperture.

In one embodiment, the plug is attached or configured to be attached to the top portion of the base portion by sonic welding.

In one embodiment, the plug comprises a nipple having at least one orifice wherein the orifice is configured to form as the egress opening.

In one embodiment, the at least one orifice is substantially circular with a diameter between 2 mm and 8 mm.

In one embodiment, the at least one orifice is substantially circular with a diameter of 3 mm or 5 mm or 6 mm.

In one embodiment, the plug is more rigid (harder) than the housing and the lid.

In one embodiment, the plug is from a polymeric material, preferably plastic.

In one embodiment, the plug is transparent.

In one embodiment, the plug is made of a polypropylene material and is more rigid than the housing and the lid.

In one embodiment, the polypropylene material has an Izod impact strength (or notched Izod impact strength) that is greater than 43 J/m at room temperature (preferably 23 degrees Celsius) when measured in accordance with ASTM D256-10 Method A.

In one embodiment, the polypropylene material has an Izod impact strength (or notched Izod impact resistance) of or about 42 J/m at −20 degrees Celsius when measured in accordance with ASTM D256-10 Method A.

In one embodiment, the polypropylene material has an Izod impact strength (or notched Izod impact resistance) of or about 165 J/m at room temperature (preferably 23 degrees Celsius) when measured in accordance with ASTM D256-10 Method A.

In one embodiment, the polypropylene material has a tensile strength at yield of or about 18.6 MPa when measured in accordance with ASTM D638-10 Type 1.

In one embodiment, the polypropylene material has a tensile strength at yield of less than 28 MPa (preferably tensile strength at yield of 18.6 MPa) when measured in accordance with ASTM D638.

In one embodiment, at least the housing is squeezable by a user's hand and is non-fragile when such squeezing force is applied, and the lid is sufficiently strong for the hinge to function during normal use.

In one embodiment, the housing, the lid and the hinge are made of a construction material that is or comprises, polyolefin, preferably thermoplastic polyolefin.

In one embodiment, the construction material is or comprises polypropylene.

In one embodiment, the wall thickness of the housing and/or the lid is 3 mm or less. In one embodiment, the plug comprises a base that is configured to be attached to the lid to seal the aperture, wherein the plug further comprises a nipple protruding upwardly from the base, the at least one orifice being formed on the nipple.

In one embodiment, the plug is configured to be engaged and interlock with a plug engagement portion with snap fit or snug fit arrangement.

In one embodiment, the plug is configured to be attached to the lid by sonic welding.

In one embodiment, the nipple is adapted engage and interlock with a plug engagement member of the plug engagement portion, the plug engagement member being formed as a circular rim.

In one embodiment, the plug further comprises a recess or a hole that is formed on the base and that is spaced apart from the nipple, the recess or the hole being configured to receive a further plug engagement member of the plug engagement portion, the further plug engagement portion being formed as a pin.

In one embodiment, the plug is from a polymeric material, preferably plastic.

In one embodiment, the plug is made of a polypropylene material.

In one embodiment, the plug is configured to allow a foil to be affixed to the plug to seal the at least one orifice.

In one embodiment, the plug is transparent.

In a seventh aspect, the invention broadly resides in a container containing at least one flowable material, wherein the container is the one as defined in any one of the aspects and/or statements above.

In one embodiment, the at least one flowable material is a cosmetic or a toiletry item in a fluid form (such as a liquid).

In an eighth aspect, the invention broadly resides in a container for storing and dispensing a flowable material that is in liquid or fluid form, the container made of a construction material which when supplied as specimen in a resin pellet form has at least one (preferably all) of the properties set out in Table 1 below:

TABLE 1

| Typical Resin Properties | Nominal Values | Unit | Test method |
|---|---|---|---|
| Melt flow 2.16 kg, 230° C. | Between 70.0 to 90.0 (more preferably 80.0) | g/10 min | ASTM D1238-10 Procedure A |
| Density Specimen conditioned for min 40 hours at 23° C. and 50% RH | Between 0.750 to 0.950 (more preferably 0.897) | g/cc | ASTM D792-08 Method A |
| Tensile Strength at Yield Specimen Thickness: 3 mm; Testing Speed: 500 mm/min | Less than 28 (more preferably 18.6) | MPa | ASTM D638-10 Type I |
| Tensile Strength at Break Specimen Thickness: 3 mm; Testing Speed: 500 mm/min | Between 12.5 to 14.5 (more preferably 13.5) | MPa | ASTM D638-10 Type I |
| Elongation at Yield in 50 mm Specimen Thickness: 3 mm; Testing Speed: 500 mm/min | Between 9.8 and 11.8 (more preferably 10.8) | % | ASTM D638-10 Type I |

TABLE 1-continued

| Typical Resin Properties | Nominal Values | Unit | Test method |
|---|---|---|---|
| Nominal Strain at Break Specimen Thickness: 3 mm; Testing Speed: 500 mm/min | Between 80 to 100 (more preferably 89) | % | ASTM D638-10 Type I |
| Flexural Tangent Modulus | Between 415 to 450 (more preferably 433) | MPa | ASTM D790-10 Procedure A |
| Flexural Strength At 5% Strain | Between 10 and 20 (more preferably 15) | MPa | ASTM D790-10 Procedure A |
| Izod Impact Resistance (at room temperature) 2 ft-lbf (2.7J) Pendulum) Type of Failure: Complete Break | Greater than 4343 (more preferably 165) | J/m | ASTM D256-10 Method A |
| Izod Impact Resistance (−at 20° C.) At −20° C. 2 ft-lbf (2.7J) Pendulum) Type of Failure: Complete Break | Between 40 to 50 (more preferably 42) | J/m | ASTM D256-10 Method A |

In one embodiment, the container is the one as defined in any one of the above aspects.

In a ninth aspect, the invention broadly resides in a method of storing at least one flowable material (that is preferably in a fluid form such as a liquid) inside a container, the method comprising:

providing the container as defined in any one of the above aspects and/or statements;

filling the housing of the container with the flowable material; and sealing the container with a sealing means and/or the plug.

In a tenth aspect, the invention broadly resides in a container for storing and dispensing a flowable material (that is preferably in a fluid form such as a liquid), the container comprising a housing and a lid that are both made as a single piece by single injection moulding of a single polymeric material that has an Izod impact strength (or notched Izod impact strength) that is greater than 43 J/m at room temperature (preferably 23 degrees Celsius) when measured in accordance with ASTM D256-10 Method A.

In one embodiment, the polymeric material has an Izod impact strength (or notched Izod impact resistance) of or about 42 J/m at −20 degrees Celsius when measured in accordance with ASTM D256-10 Method A.

In one embodiment, the polymeric material has an Izod impact strength (or notched Izod impact resistance) of or about 165 J/m at room temperature (preferably 23 degrees Celsius) when measured in accordance with ASTM D256-10 Method A.

In one embodiment, the polymeric material has a tensile strength at yield of or about 18.6 MPa when measured in accordance with ASTM D638-10 Type 1.

In one embodiment, the polymeric material has a tensile strength at yield of less than 28 MPa (preferably tensile strength at yield of 18.6 MPa) when measured in accordance with ASTM D638.

In one embodiment, the container is the one as defined in any one of the above aspects and/or statements.

In an eleventh aspect, the invention broadly resides in a plug of a container for storing and dispensing a flowable material, the container comprising:

a housing that is hollow with a closed end, the housing being configured to store at least one flowable material that is to be dispensed from the container; and a lid that is configured to be integrally formed with the housing, the lid comprising a base portion and a cap portion, the cap portion being pivotably mounted to the base portion by a hinge that is a part of the lid;

the lid being configured transition between an open position and a closed position, wherein in the open position the cap portion of the lid is configured to move away from the base portion and when in the closed position the cap portion of the lid is configured to move towards the base position and physically engage with the base position, the housing and the lid are made as a single piece by single injection moulding process, wherein the plug being or is configured to be inserted and attached to the lid to at least partially or fully seal an aperture formed on the base portion of the lid, at least one orifice is formed or configured to be formed on the plug to function as an egress opening through which at least one flowable material stored in the housing is configured to be dispensed, wherein the plug is configured to engage and interlock with a plug engagement portion formed of the cap portion of the lid when the lid is in a closed position thereby allowing the lid to be securely locked into the closed position, when in the closed position the at least one orifice is clear from engagement or alignment with the plug engagement portion.

In one embodiment, the plug comprises a base that is configured to be attached to the lid to seal the aperture, wherein the plug further comprises a nipple protruding upwardly from the base, the at least one orifice being formed on the nipple.

In one embodiment, the plug is configured to be engaged and interlock with a plug engagement portion with snap fit or snug fit arrangement.

In one embodiment, the plug is configured to be attached to the lid by sonic welding.

In one embodiment, the nipple is adapted engage and interlock with a plug engagement member of the plug engagement portion, the plug engagement member being formed as a circular rim.

In one embodiment, the plug further comprises a recess or a hole that is formed on the base and that is spaced apart from the nipple, the recess or the hole being configured to receive a further plug engagement member of the plug engagement portion, the further plug engagement portion being formed as a pin.

In one embodiment, the plug is from a polymeric material, preferably plastic.

In one embodiment, the plug is made of a polypropylene material.

In one embodiment, the plug is configured to allow a foil to be affixed to the plug to seal the at least one orifice.

In one embodiment, the plug is transparent.

In a twelfth aspect, the invention broadly resides in plug as defined in any one of the above aspects and/or statements when used with a container as defined in any one of the above aspects and/or statements.

In a thirteenth aspect, the invention broadly resides in a plug of a container as defined in any one of the above aspects and/or statements.

In a fourteenth aspect, the invention broadly resides in a product stored inside the container as defined in any one of the above aspects and/or statements.

In a fifteenth aspect, the invention broadly resides in use of a container as defined in any one of the above aspects and/or statements to store at least one product inside the container and/or to dispense at least one product that is already stored inside the container.

Other aspects of the invention may become apparent from the following description which is given by way of example only and with reference to the accompanying drawings.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings and described in the following description are simply exemplary embodiments of the invention. Hence, specific dimensions and other physical characteristics related to the embodiments disclosed herein are not to be considered as limiting.

It is acknowledged that the term "comprise" may, under varying jurisdictions, be attributed with either an exclusive or an inclusive meaning. For the purpose of this specification, and unless otherwise noted, the term 'comprise' shall have an inclusive meaning, allowing for inclusion of not only the listed components or elements, but also other non-specified components or elements. The terms 'comprises' or 'comprised' or 'comprising' have a similar meaning when used in relation to the system or to one or more steps in a method or process.

As used hereinbefore and hereinafter, the term "and/or" means "and" or "or", or both.

As used hereinbefore and hereinafter, "(s)" following a noun means the plural and/or singular forms of the noun.

When used in the claims and unless stated otherwise, the word 'for' is to be interpreted to mean only 'suitable for', and not for example, specifically 'adapted' or 'configured' for the purpose that is stated.

For the purposes of this specification, the term "plastic" shall be construed to mean a general term for a wide range of synthetic or semisynthetic polymerization products, and generally consisting of a hydrocarbon-based polymer.

For the purpose of this specification, where method steps are described in sequence, the sequence does not necessarily mean that the steps are to be chronologically ordered in that sequence, unless there is no other logical manner of interpreting the sequence.

The entire disclosures of all applications, patents and publications, cited above and below, if any, are hereby incorporated by reference.

BRIEF DESCRIPTION OF THE DRAWINGS

Preferred embodiments of the invention will be described by way of example only and with reference to the drawings, in which:

FIG. 5: shows a partial perspective view of the container of FIG. 1 with comprising a plug about to be attached to the container, where the lid of the container is in open position.

FIG. 6: shows a partial perspective view of the container of FIG. 5 with the plug attached to the lid of the container.

FIG. 7: shows a top view of the lid of container of FIG. 6 with the plug attached to the lid.

FIG. 12A shows a perspective view of the container in an open position without the plug. FIG. 12B shows a perspective view of the container with the plug about to be inserted and attached and inserted to the lid. FIG. 12C shows a perspective view of the container with the plug inserted and attached and inserted to the lid.

FIG. 13A shows a perspective view of the container in an open position without the plug. FIG. 13B shows a perspective view of the container with the plug about to be inserted and attached and inserted to the lid. FIG. 13C shows a perspective view of the container with the plug inserted and attached and inserted to the lid.

FIG. 14A shows a perspective view of the container in an open position without the plug. FIG. 14B shows a perspective view of the container with the plug about to be inserted and attached and inserted to the lid. FIG. 14C shows a perspective view of the container with the plug inserted and attached and inserted to the lid. FIG. 14D shows a partial perspective view of the container with a foil affixed to the plug FIG. 14E shows a partial perspective view of the container with without a foil affixed to the plug.

DETAILED DESCRIPTION

With reference to the above drawings, a container for storing and dispensing a flowable material according to one aspect of the invention is generally indicated by the numeral 100.

The container 100 comprises a housing 102 and a lid 104. As shown, the container 100 may be in the form of a tube. The housing 102 is hollow and is configured to store at least one flowable material that is to be dispensed from the container 100. The flowable material is preferably but not necessarily a personal care or a toiletry item such as shampoo, conditioner, body wash, toothpaste, lotion, hair gel or the like. The at least one flowable material is preferably in a fluid form (such as a liquid) but optionally could be in a granular or a powdered form.

Also, unless otherwise explicitly stated, any example(s) of flowable material mentioned in this specification should not be considered as limiting. Also, unless otherwise explicitly stated any size(s) and/or dimension(s) specified in this specification should not be considered as limiting.

Figure 1:
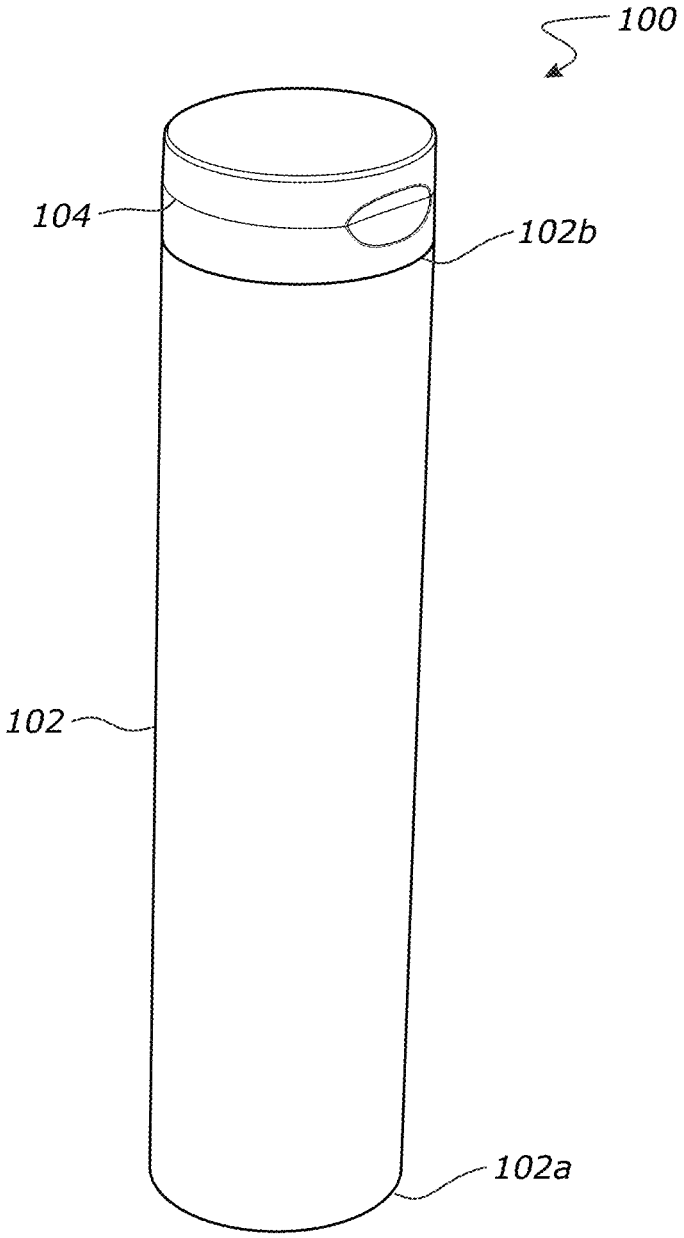
FIG. 1: shows one preferred example/embodiment of a perspective view of a container for storing and dispensing a flowable material according to the present invention, where the container is in closed position.
Figure 2:
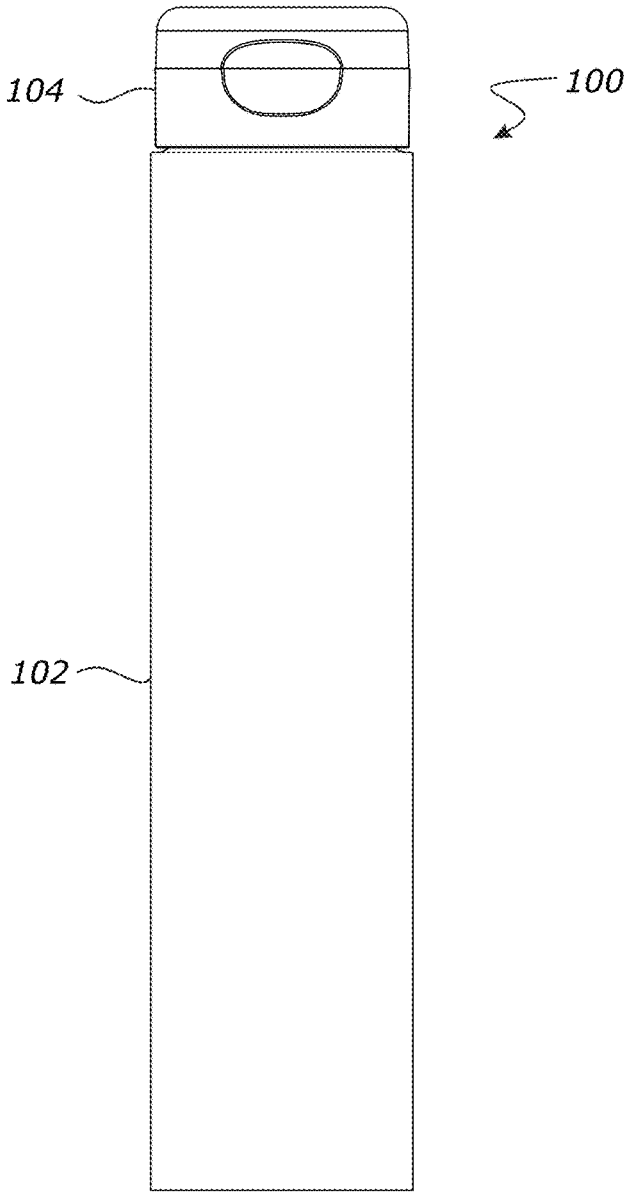
FIG. 2: shows a side elevation view of the container of FIG. 1.
Figure 3:
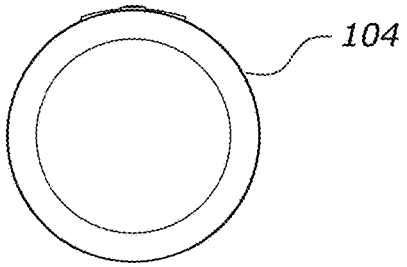
FIG. 3: shows a top plan view of a lid of the container of FIG. 1 in closed position.

The lid 104 is movable i.e. transition between an open position as shown for example in FIGS. 4-7 and a closed position as shown for example in FIGS. 1, 2 and 3. As shown in FIGS. 6-7, when in the open position the lid 104 is configured to reveal an egress opening 106 through which the flowable material is configured to be dispensed. More specifically, as shown in FIGS. 5-7, the lid 104 may comprise a base portion 105 and a cap portion 107, and when in an open position, the cap portion 107 of the lid 104 may reveal the egress opening 106. As will be described later, the egress opening 106 may be in the form of at least one orifice 114 of a plug 112. Similarly, as shown in FIGS. 1 and 6, when in the closed position, the lid 104 is configured to conceal the egress opening 106. More specifically, when in the closed position as shown in FIGS. 1 and 6, the cap portion 107 of the lid 104 may conceal the egress opening 106. Since the egress opening 106 is concealed by the lid 104 (more specifically, the cap portion 107 of the lid) during the closed position, the flowable material stored inside the housing 102 is prevented from dispensing during the closed position. In the preferred form, the lid 104 (more specifically. the cap portion 107 of the lid 104) is pivotally movable or is configured to transition between an open position as shown for example in FIGS. 4-7 and a closed position as shown for example in FIGS. 1-3 using a hinge 109. The hinge 109 may be formed as part of the lid 104.

As shown in FIG. 1, the housing 102 may extend from a first end 102*a* to a second end 102*b*, i.e., between the first end 102*a* and the second end 102*b*. In other words, the housing 102 may be an elongated housing extending longitudinally from the first end 102*a* and the second end 102*b*. The first end 102*a* may be a closed end.

The lid 104 may be configured to be mounted to the second end 102*b*. It is preferable that the lid 104 is integrally formed with the housing 102 at the second end 102*b*, and preferably the housing 102 and the lid 104 are both made from the same construction material or the same construction material of the same chemical formulation. In one embodiment, the housing and the lid is made of construction material that is or comprises polyolefin, preferably thermoplastic polyolefin. In one embodiment, the housing 102 and the lid 104 are both made of a construction material that is or comprises polypropylene (PP). Having an integrally formed one-piece container 100 may mean that the container 100, more particularly, the housing 102 and the lid 104 of the container 100 can be made by a single injection moulding process, which can significantly reduce the manufacturing costs as compared to a two-piece or multi-piece container (e.g. a turning cap container) which would typically require its lid and the housing to be manufactured separately thereby involving more complex manufacturing techniques requiring additional manufacturing steps. Further, a person skilled in the art will appreciate that combining the lid 104 and the housing 102 as one piece can be useful when it comes to weight saving. The overall weight of the container 100 of the present invention that is made by a single injection moulding process in which the lid 104 and the housing 102 are formed as one piece can provide a weight saving of approximately 30%. Further, having the housing 102 and the lid 104 made out of the same construction material of same chemical formulation is also advantageous as the construction material of both the lid 105 and housing 102 can be processed together during the manufacturing of the container 100. This can reduce the complexity of the manufacturing process of the container 100 and overall manufacturing costs. Also, use of same construction material of the same chemical formulation further facilitates to easily manufacture the container 100 by a single injection moulding process.

Figure 11:
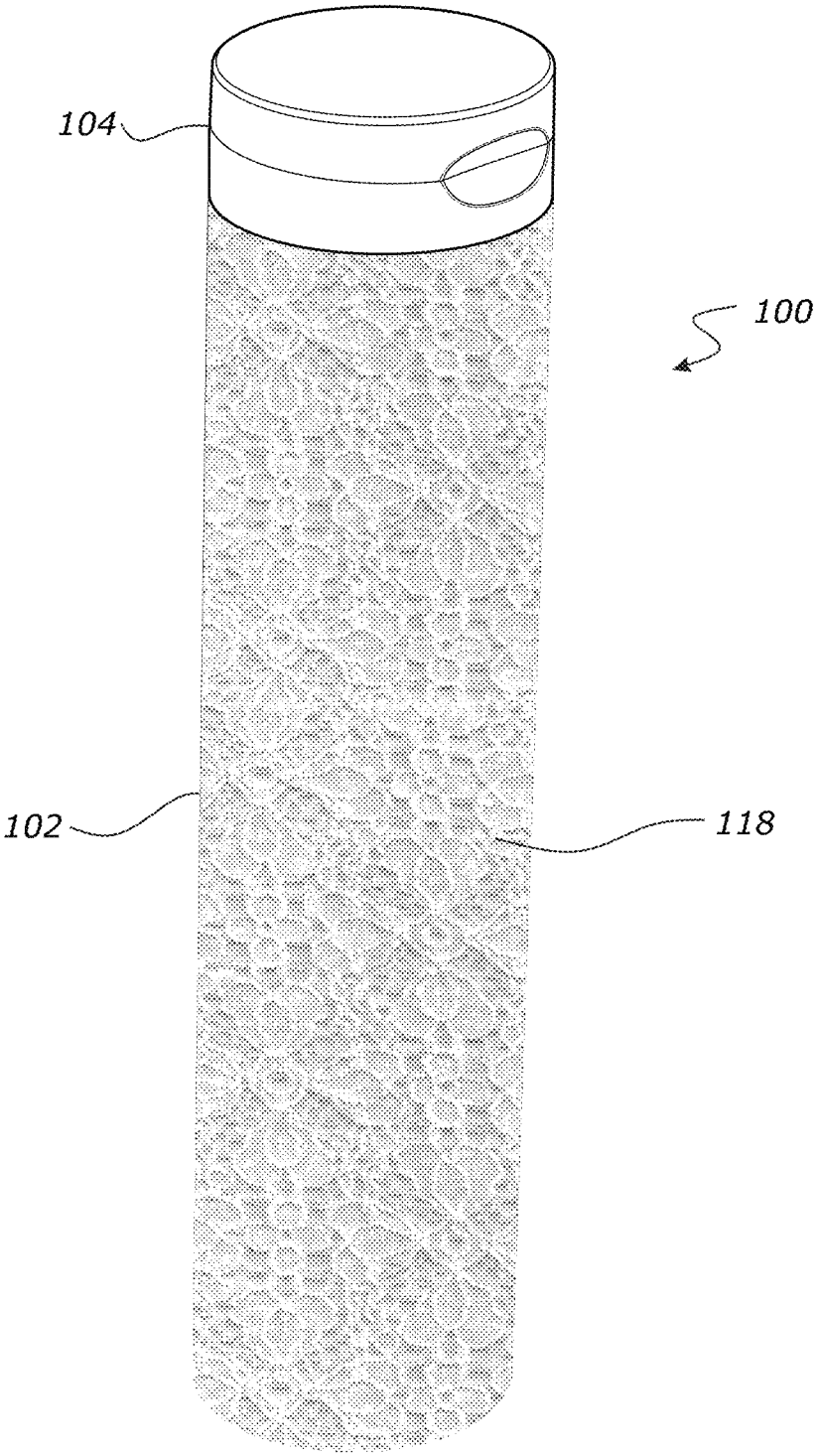
FIG. 11: shows the container in FIG. 1 with in-mold labelling/decoration.

The container 100 may be an In-Mold-Labeled (IML) tube as shown in FIG. 11. Such IML tube may be manufactured by an injection molding and may incorporated an in-mold label for any graphic decoration needed. The process may include inserting printed in-mold label into a mold and 'shot' with a polypropylene resin. The container 100 is preferably formed in one piece. The label 118 is basically embedded in the walls of the container 100, forming an integral part of the container wall and protecting decoration from scuffs during distribution and use. Additionally, since in-mold labels such as label 118 are of a high-quality graphic resolution, the branding of the product packaged in container 100 in the form of such IML tube can stand out visually to the point of sale which can result in significant commercial advantages.

In one embodiment, the container 100 is a single use container. In certain applications, single use containers are not only convenient to use but are also important for hygiene reasons as they can prevent spread of germs and/or infections.

As shown, the housing 102 may be substantially tubular with a substantially uniform cross-sectional area or diameter (both inner and outer diameter) throughout the length of the housing 102. The housing 102 may be substantially annular in cross-section when in a plane that is orthogonal to the longitudinal axis of the container 100. In other words, the housing may be a hollow cylindrical in shape. In one embodiment, the external diameter of the housing is less than 50 mm. In one embodiment, the external diameter of the housing is greater than 40 mm but less than 60 mm. In one embodiment, the external diameter of the housing is 48.5 mm. The wall thickness of the housing may be 3 mm or less than 3 mm, e.g. 2 mm or 1 mm. A housing having such substantially annular or circular cross-section can be advantageous over housings having polygonal cross-sections with corners. For example, if the housing 102 was rectangular or similar polygonal shape with corners in cross-section, then there is a possibility of deposition of flowable material at one or more corners in the inside wall of the housing 102. However, by having a substantially circular/annular cross-section such deposition of flowable material at the corner of the inside wall of the housing can be prevented.

The first end 102*a* which is a closed end may be integrally formed as part of the housing 102 and is shaped to allow the container 100 to stand-up vertically on a horizontal surface. For example, a flat container base may be formed at the first end. In one embodiment, the housing 102 is between 150 mm and 250 mm in length/height.

As shown, the lid 104 may also be substantially annular in cross-section in a plane that is orthogonal to the longitudinal axis of the container 100. In one embodiment, the external diameter of the lid 104 is less than 50 mm. In one embodiment, the external diameter of the lid is greater than 40 mm but less than 60 mm. In one embodiment, the external diameter of the lid is 48.5 mm. In one embodiment, the length/height of the lid 104 is less than 30 mm. In one embodiment, the length/height of the lid 104 is between 15 mm to 25 mm. In one embodiment, the length/height of the lid 104 is 20 mm.

Figure 4:
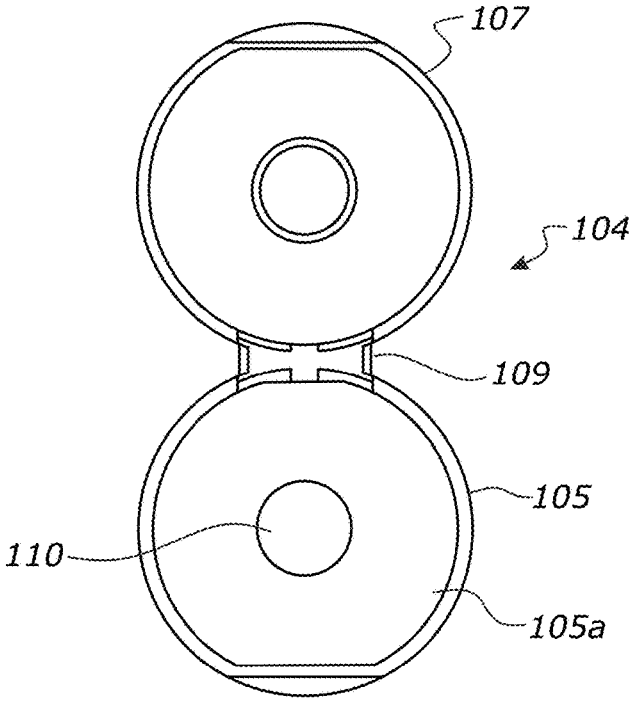
FIG. 4: shows a top plan view of a lid of the container of FIG. 1 in an open position.

As shown in FIGS. 4-6 and as mentioned above, the lid 104 comprise a base portion 105 and a cap portion 107. The cap portion 107 may be pivotally mounted to the base portion 104*a* by the hinge 109. The base portion 105 may be mounted to (preferably integrally formed with) the second end 102*b* of the housing 102. More specifically, the base portion 105 of the lid 104 may comprise a top portion 105*a* and a bottom portion 105*b* with an annular wall 105*c* extending between the top portion 105*a* and the bottom portion 105*b*. The cap portion 107 may be pivotally mounted to the top portion 105*a* by the hinge 109 and the bottom portion 105*b* of the base portion 105 may be mounted to (preferably integrally formed with) the second end 102*b* of the housing 102. The hinge 109 may be integrally formed with the base portion 105 and the cap portion 107 as part of the lid 104. In one embodiment, the height of the cap portion 107 is the same as the base portion 105. In one embodiment, the height of the cap portion 107 is different from the base portion 105. In one embodiment the height of the cap portion 107 and/or the base portion 105 is between 8 mm and 12 mm. In one embodiment the height of the cap portion 107 and/or the base portion 107 is 10 mm.

As shown in FIG. 4, the top portion 105*a* of the base portion 105 of the lid 104 may be substantially flat and may comprise an aperture 110.

In one embodiment, the aperture 110 may function as the egress opening through which the flowable material can be dispensed. The aperture 110 may be substantially circular in shape and may be configured to be at least partially sealed, but preferably fully sealed, by a foil 113 which can be punctured using a suitable means to allow dispensing of the flowable material stored inside the housing through the aperture 110.

As shown in FIGS. 5-7, the container 100 may comprise a sealing member in the form of a plug 112. The plug 112 may be used in addition to the foil 113 or it could be used without the foil 113. Using the foil 113 is advantageous because not only can the foil 113 be used to seal the aperture 110 but can also be used to detect tampering. For example, if the foil is broken, torn or punctured, then that can indicate tampering or tampering attempt. Therefore, by having the foil 113, the container 100 can be used to store contents e.g. medicines, cosmetic products etc. that often require tamper-resistant packaging. Tamper-resistant packaging is often mandatory requirements to comply with regulatory guidelines imposed by the regulatory bodies. By being able to use a foil in such a manner, the container of the present invention allows full compliance with such regulatory requirements without adding unnecessary complexity to the design.

As shown in FIGS. 5-7 and 8*a*-8*d*, the plug 112 may comprise a base 112*a* which may be annular and may be inserted and attached to the lid. The plug may be attached to the lid 105 at the top portion of the base portion 107 to at least partially (preferably fully) seal at least the aperture 110 that is formed on the base portion 105 of the lid 104.

An annular ledge 111 may be formed inside the aperture 110.

In one embodiment, the diameter of the aperture 110 at the top portion 105*a* of the base portion 105 is same or similar to the diameter of the annular base 112*a* of the plug 112. In one embodiment, the diameter of the aperture 110 at the top portion 105*a* of the base portion 105 is smaller than the diameter of the base 112*a* of the plug 112. In one embodiment, the diameter of the aperture 110 is between 91 mm and 18 mm. In one embodiment, the diameter of the aperture is 14 mm.

The plug 112 may comprise at least one orifice 114. Instead of the aperture 110, the foil 113 may be configured to seal the orifice 114. Having a foil 113 to seal the orifice is even more advantageous because such configuration can also be used to detect the tampering of the plug 112. For example, if the foil is broken or punctured, then that can indicate tampering or attempted tampering of the plug, and consequently also the tampering of the container 100.

In some embodiments, two foils may be used, one foil may be used to seal the aperture 110 another foil to seal the orifice 114.

As shown, the plug 112 may comprise a protruded portion, i.e. a nipple 112*b* and the orifice 114 may be formed at the nipple 112*b*. As shown, the nipple 112*b* may protrude upwardly from the base 112*a*. In one embodiment, orifice 114 has a diameter between 1.5 mm and 8 mm. In one embodiment, orifice 114 has a diameter of 3 mm or 5 mm or 6 mm.

Figure 8A:
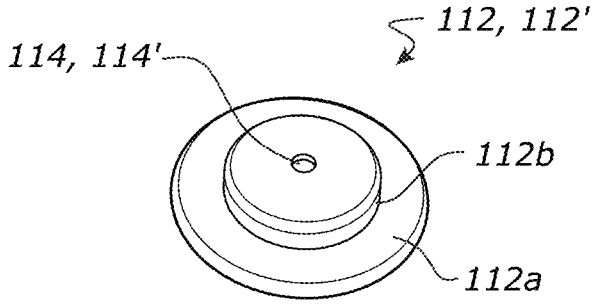
FIGS. 8A-8D: show a different example of plugs that can be used with the container of FIG. 1.
Figure 8B:
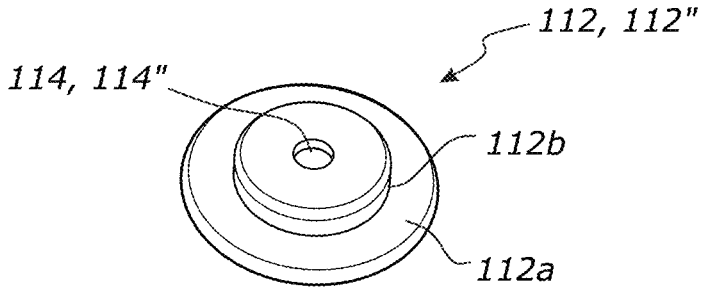
Figure 8C:
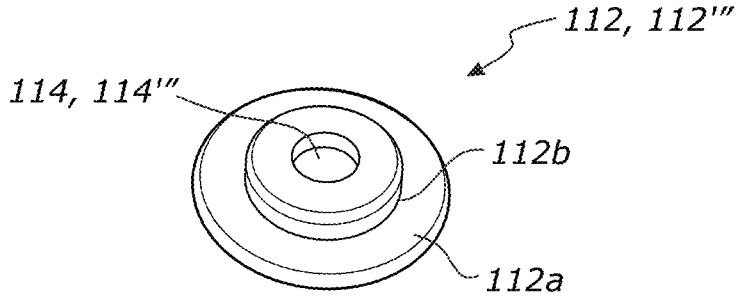
Figure 8D:
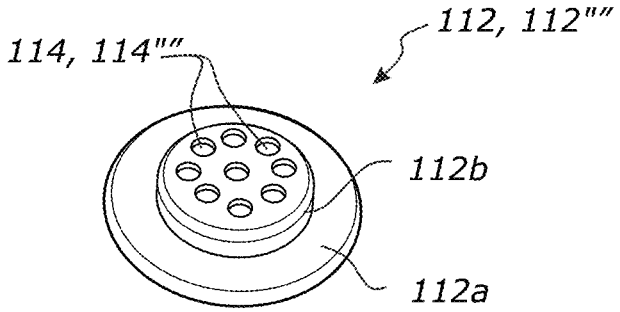

As shown in FIGS. 8*a*-8*d*, different types of plugs 112', 112", 112''', 112'''' may be used as the sealing member. The size or the orifice 114 of each plug in may be different. For example, the orifice 114' may have a diameter of 3 mm, the orifice 114" may have a diameter of 5 mm and the orifice 114''' may have a diameter of 6 mm. As shown in FIG. 8*d*, the plug may even have multiple orifices 114'''' and orifices 114'''' may be all of the same diameter or different diameters. For example, each orifice 114'''' may have a diameter between 1.5 mm and 8 mm or the orifices 114'''' may have different diameters between 1.5 mm and 8 mm.

Optionally, the shape of the orifice 114 or each orifice 114 of the plug 112 may also be different. For example, the orifice 114 may be rectangular, oval, square or of many other suitable shape or combination of shapes. Optionally, the plug 112 may not have any orifice and during use, the user may manually form one or more orifices of a desired shape and/or size on the plug 112 using a suitable puncturing means e.g. a needle. Therefore, the orifice 114 may be already formed on the plug 112 or may be configured to be formed on the plug 112.

It will be appreciated that due to the presence of the plug 112 as described above, the container 100 will no longer be confined to an egress opening of a fixed size and/or shape. Therefore, by using the plug 112, size and/or shape of the egress opening 106 can be varied depending upon the characteristics (e.g. flow rate, viscosity etc.) of flow material stored inside the housing 102. This makes the container 100 suitable for storing and effectively dispensing desired volume of many different types of flowable materials of different characteristics, e.g. flow rates, viscosities etc. Similarly, depending upon the customer's requirements and/or material stored inside the housing 102 of the container 100, the size and/or shape of the egress opening 106 by interchanging different plugs quickly and conveniently during packaging stage. This can be very useful for manufacturing and/or packaging industries.

The plug 112 may be inserted and attached to the lid 104 by a sonic welding process. This may be done during manufacture/packaging stage. For example, the container 100, more specifically at least the housing 102, may be filled with flowable material through the aperture 110 and once filled, the plug may be attached to the lid 104 by a sonic welding process. The annular ledge 111 allows welding the plug 112 to the lid 104 by sonic welding process.

The housing 102 and the lid 104 may be of the same colour or a different colour. The plug 112 may be formed to be transparent so that the user can see the content inside the housing 102 through the plug 104.

In one embodiment, the invention can be said to reside in a container such as a container 100 that is made by single injection moulding with single PP material. Therefore, in one aspect, the entire housing 102 and the entire lid 104 (including the hinge 109) of the container 100 is made as a single piece by single injection-moulding of PP material that is soft enough for the container 100 to pass all common drop tests in the market while at the same time hard and strong enough to allow the hinge 100 to function.

At least the housing 102 is preferably non-fragile and are squeezable by a user's hand during normal use. In other words, wherein, at least the housing is squeezable by a user's hand and is non-fragile when such squeezing force is applied, and the lid 104 is sufficiently strong for the hinge 109 to function during normal use. The lid 104 may be squeezable similar to the housing 102. Alternatively, and more preferably, the hardness and squeezability of the lid 104 will be different from the housing due to difference in wall thickness. For example, the wall thickness of the lid 104 may be 1 mm or approximately 1 mm and the wall thickness of the housing 102 may be 0.5 mm or approximately 0.5 mm. Consequently, the hardness and squeezability of the lid 104 will be different as compared to the housing 102 even though both of them are made out of the same material.

The housing 102 and the lid 104 are both made from one single material, the material being a polypropylene material.

It will be appreciated that if the container 100 is made of soft material (i.e. material that is soft enough to make the container squeezable), there is a risk that the lid 104 will not pass a lid opening force measurement test, which is a standard test performed in the industry to measure the minimum force that is required to move the lid 104 from the closed position to the open position. In order to overcome this risk of failing the lid 104 opening force measurement test, the plug 112 is preferably made of a PP material that is of greater hardness (higher rigidity) than the lid 104 and consequently also of greater hardness (higher rigidity) than the housing 102. Since the lid 102 is softer than the plug 112, the plug 112 can lock with the lid 104 more firmly, thereby passing the lid opening force measurement test used in the industry. Without such a plug 112, the entire lid 104 could be too soft to pass the lid opening force measurement test.

In one embodiment, the construction material is a polymeric material, preferably a polypropylene material, that has an Izod impact strength (or notched Izod impact strength) greater than 43 J/m at room temperature (preferably 23 degrees Celsius) when measured in accordance with ASTM D256-10 Method A. In one embodiment, the polymeric material that has an Izod impact strength (or notched Izod impact resistance) of or about 42 J/m at −20 degrees Celsius when measured in accordance with ASTM D256-10 Method A. In one embodiment, the polymeric material has an Izod impact strength (or notched Izod impact resistance) of or about 165 J/m at room temperature (preferably 23 degrees Celsius) when measured in accordance with ASTM D256-10 Method A.

Such a higher Izod impact strength value is advantageous as it provides proper and required strength to the material as compared to a material that has an Izod impact strength (or notched Izod impact strength) of lower than 43 J/m at room temperature (preferably 23 degrees Celsius) when measured in accordance with ASTM D256-10 Method A.

In one embodiment, the polymeric material has a tensile strength at yield of or about 18.6 MPa when measured in accordance with ASTM D638-10 Type 1. In one embodiment, the polymeric material has a tensile strength at yield of less than 28 MPa (preferably tensile strength at yield of 18.6 MPa) when measured in accordance with ASTM D638.

Such a lower tensile strength value is advantageous as it allows the material to be more ductile and more resistance to impact as compared to a polymeric material that has a tensile strength at yield of 28 MPa or more (when measured in accordance with ASTM D638).

Figure 12C:
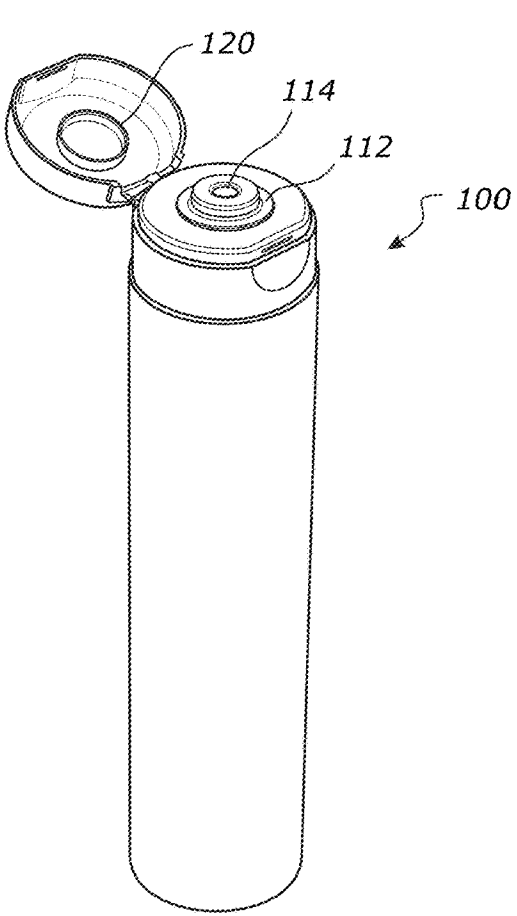
FIG. 12A-12C: show perspective views of the container of FIG. 1 in an open position.
Figure 12B:
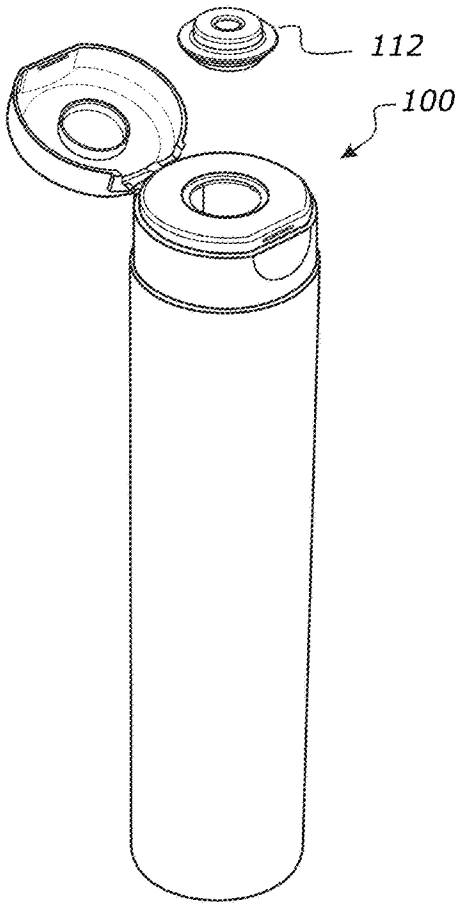
Figure 12A:
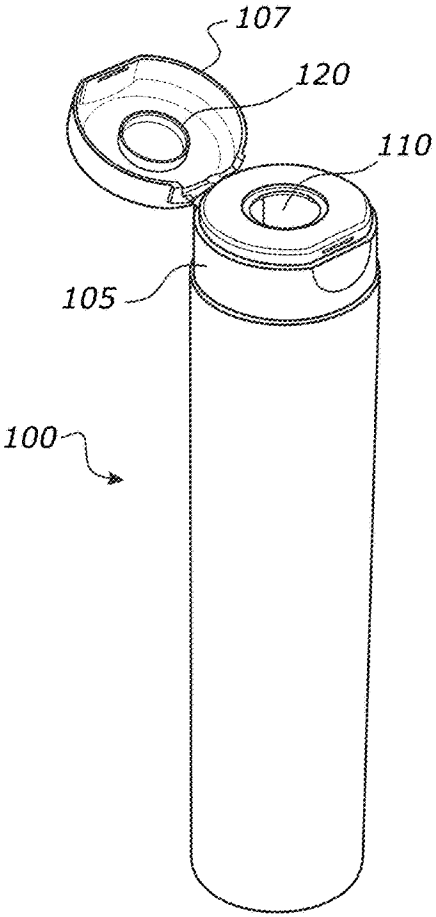

FIG. 12A shows the container 100 with the lid 104 in the open position without the plug 112. FIG. 12B shows the container 100 of FIG. 12A and the plug 112 that is to be inserted and attached to the lid 104 to at least partially seal the aperture 110. FIG. 12C shows container 100 of FIG. 12A and the plug 112 is attached and inserted to the lid 104 to at least partially seal the aperture 110.

As shown, a plug engagement portion 120 may be formed on the cap portion 107. In the closed position, the plug engagement portion 120 may be configured to engage and interlock with the plug 112 to allow the lid 120 to be securely locked into the closed position. It can be appreciated that with the arrangement shown, the orifice 114 of the plug 112 is clear from any engagement or alignment with the plug engagement portion 120. In other words, even when the lid 104 is in the closed position, the orifice 114 of the plug 112 is neither blocked nor in any way physically engaged with the plug engagement portion 120. When in the closed position, the nipple 112*b* engages and interlocks with the plug engagement portion 120 which in example shown in the form of a circular rim (preferably of same, similar or slightly larger diameter than the diameter of the nipple 112*b*), however there is no engagement or alignment of the plug engagement portion 120 with the orifice 114. Such an arrangement is advantageous because it allows a foil to be affixed to the plug over the orifice 114 as a tamper-proof item without the plug engagement portion 120 puncturing, tearing or damaging the foil when the lid 104 is in the closed position. The plug engagement portion 120 and the nipple may engage and interlock together with a snap fit or snug fit arrangement.

Figure 9:
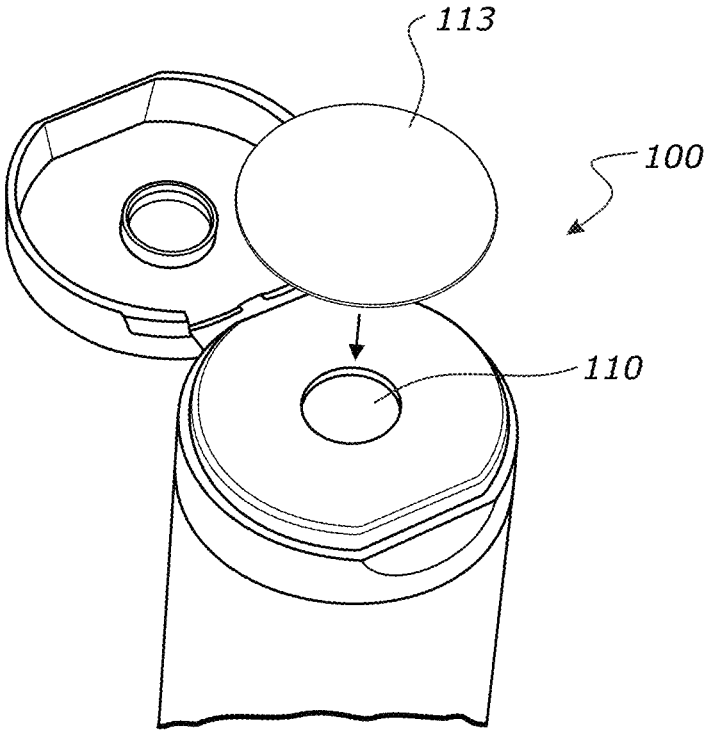
FIG. 9: shows a partial perspective view of the container of FIG. 1 with comprising a foil about to be attached to the container, where the lid of the container is in open position.
Figure 10:
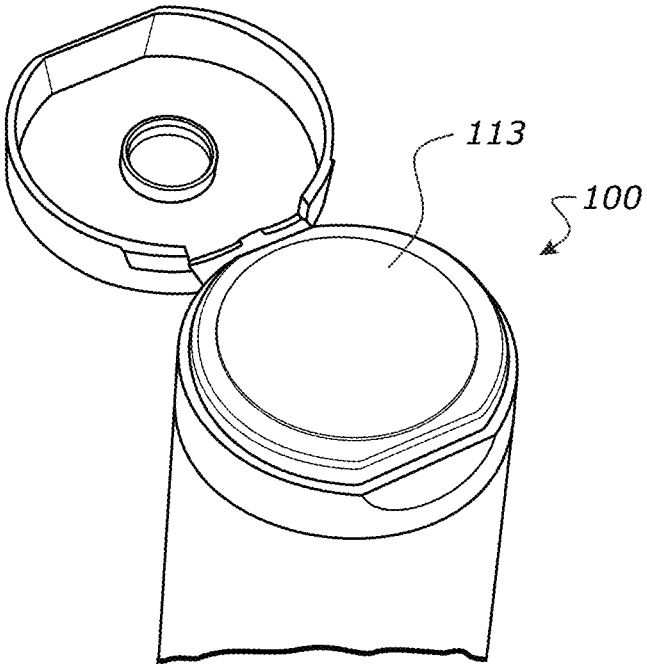
FIG. 10: shows a partial perspective view of the container of FIG. 10 with the plug attached to the lid of the container.
Figure 13C:
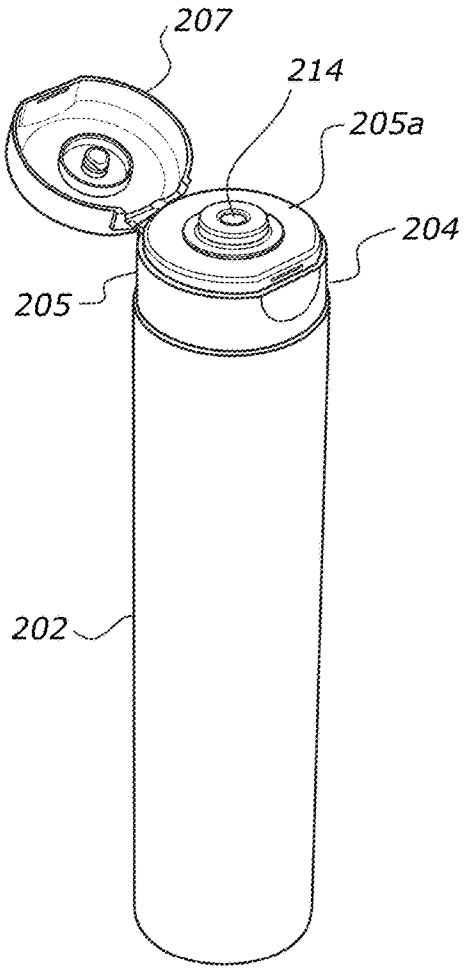
FIG. 13A-13C: show another example/embodiment of a container for storing and dispensing a flowable material according to the present invention, where the container is in an open position.
Figure 13B:
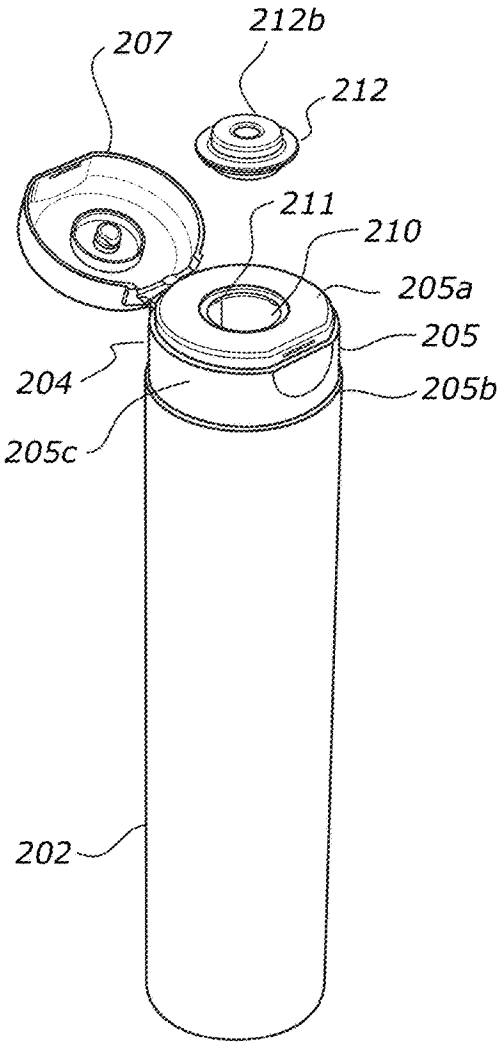
Figure 13A:
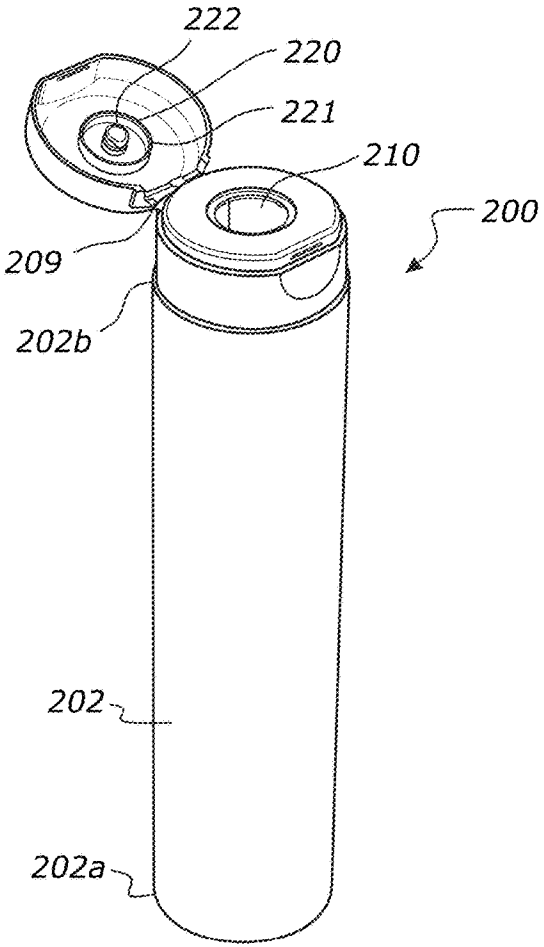

Of course, it can be appreciated that the foil need not be of the same size as shown in FIGS. 9-10. For example, the foil may be of same or smaller diameter than the nipple 112*b*. In some embodiment, the foil may approximately be of the same size as the orifice 114 to seal the orifice 114. The plug 112 need not be the one as shown in FIGS. 12A-12C may be similar to the one as described above with reference to FIGS. 8A-8D FIGS. 13A-13C show another embodiment of container 200 for storing and dispensing a flowable material. The embodiment of the container 200, in its design and functionality, largely corresponds to the embodiment of the container 100 as described above. In particular, in FIGS. 13A-13C, like or identical parts have been given the same reference numeral raised by 100. Thus, it is here mainly referred to the explanations given above, and primarily, only the differences will be described.

The plug 212 may be identical to plug 112 as described above. The plug 212 need not be the one as shown in FIGS. 13A-32C may be similar to the one as described above with reference to FIGS. 8A-8D.

The container 200 is different from the container 100 primarily in the plug engagement portion 220. As shown the plug engagement portion 220 may be in the form of two plug engagement members, namely a first plug engagement member 221 and a second plug engagement member 222. The plug engagement member 221 is preferably circular rim (preferably of same, similar or slightly larger diameter than the diameter of the nipple 212*b*) and the second plug engagement member 222 is preferably a pin or pintle. In the closed position, the plug engagement portion 220 may be configured to engage and interlock with the plug 212 to allow the lid 204 to be securely locked into the closed position. More specifically, when the closed position, the nipple 212*b* engages and interlocks with the first plug engagement member 221. Similarly, the orifice 214 engages and interlocks with the second plug engagement member 222. The first plug engagement member 221 and the nipple 212*b* may engage and interlock together with a snap fit or snug fit arrangement. The second plug engagement member 222 and the nipple and the orifice 222 may or may also engage and interlock together with a snap fit or snug fit arrangement.

The plug engagement portion 220 in the form of two plug engagement members 221, 222 engaging and interlocking with the plug 212, the strongly and tightly secures the lid to the closed position thereby preventing the cap portion 207 of the lid from easily moving to the open condition when the housing 202 of the container 200 is squeezed. Although, due to the interlocking ability (e.g. using a snug fit or snap fit arrangement) the plug engagement portion 120 of the container 100 described above may also provide some degree of securement of the lid to the container when in the closed position, by having two engagement members 221, 222, the degree of securement of the lid 200 of the container 200 is much stronger.

However, a limitation of a container 200 is that a foil cannot be affixed over the orifice 214 as a tamper-proof item. This is because, the second engagement member 222 is most likely to puncture, tear or damage any such foil when the lid 207 is in the closed position.

FIGS. 14A-14E show another embodiment of the container 300 for storing and dispensing a flowable material that solves the problems identified with the containers 100, 200 above. The embodiment of the container 300, in its design and functionality, largely corresponds to the embodiment of the container 100 as described above. In particular, in FIGS. 14A-14C, like or identical parts have been given the same reference numeral raised by 200. Thus, it is here mainly referred to the explanations given above, and primarily, only the differences will be described.

The difference between the container 200 over container 100 is primarily in the plug engagement portion 320 and the plug 312.

The cap portion 307 comprises a plug engagement portion 320 and in the closed position, the plug engagement portion is configured to engage and interlock with the complementary features of the plug 312 to be securely locked in that closed position. As shown, the plug engagement portion 320 may be in the form of two plug engagement members, namely a first plug engagement members 321 and a second plug engagement member 322.

The plug engagement member 321 is preferably a circular rim (preferably of same, similar or slightly larger diameter than the diameter of the nipple 312*b*) and the second plug engagement member 322 is preferably a pin or pintle. When in the closed position, the complementary feature i.e. the nipple 312*b* and the first plug engagement member 321, i.e. the circular rim may engage and interlock together. As shown, for engaging and interlocking with the second plug engagement member 322, the base 312*a* of the plug 312 may comprise a further complementary feature 312*c* preferably in the form of a hole or recess.

The first plug engagement member 321 and the nipple 312*b* may engage and interlock together with a snap fit or snug fit arrangement. The second plug engagement member 322 and the complementary feature 312*c* may or may also engage and interlock together with a snap fit or snug fit arrangement. As it can be seen the first and second engagement members 321, 322 and the centre points of the first and second engagement members 321, 322 may be spaced apart from one another and the nipple 312*b* and the hole or recess 312*c* and their respective centre points may also be spaced apart from each other.

The plug engagement portion 320 in the form of two plug engagement members 321, 322 engaging and interlocking with the plug 312, the strongly and tightly secures the lid to the closed position thereby preventing the cap portion 307 of the lid from easily moving to the open condition when the housing 302 of the container 300 is squeezed.

Further, it can be appreciated that with the arrangement as shown in FIGS. 14A-14E, the orifice 314 of the plug 312 is clear from any engagement with the plug engagement portion 320. In other words, even when the lid 304 is in the closed position, the orifice 314 of the plug 312 is neither blocked nor engaged with the plug engagement portion 320. When the closed position, the nipple 312*b* engages and interlocks with the plug engagement portion, more specifically with the first plug engagement member 321 which in example shown in the form of a circular rim (preferably of same, similar or slightly larger diameter than the diameter of the nipple 312*b*) and the complementary feature 312*c* or hole acts as a female latch and engages and interlocks with the second engagement portion 322 which in the example shown is in the form of the pin or pintle (which acts as a male latch). However, there is no engagement of the plug engagement portion 320 with the orifice 314. Such arrangement is advantageous because it allows a foil 313 to be affixed over the orifice 314 as a tamper-proof item without the plug engagement portion 320 puncturing, tearing or damaging the foil 313 when the lid 304 is in the closed position. The plug engagement portion 320 and the nipple 312*b* may engage and interlock together with a snap fit or snug fit arrangement.

In some embodiments, the first engagement portion 321 may be formed as a plurality of ribs or similar features to snug fit or snap fit with the nipple.

In some embodiments, the second plug engagement feature 322 may be in the form of a hole and the complementary feature 312*c* may be in the form of a pintle or pin to be engaged and interlock with the hole, preferably by snap fit or snug fit arrangement.

Figure 14C:
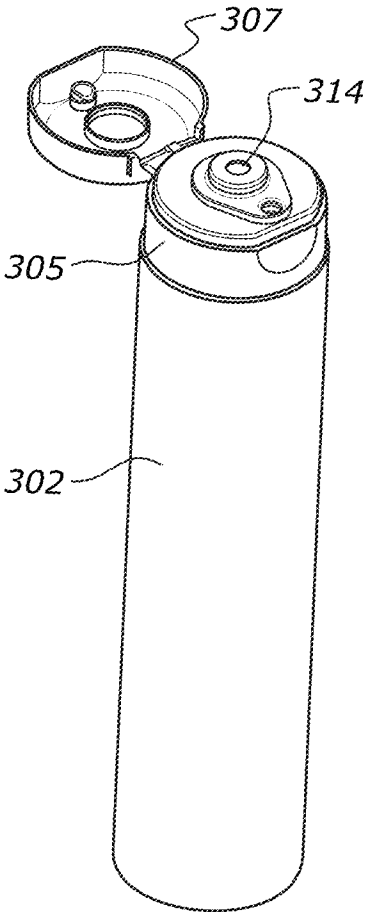
FIGS. 14A-14E: show yet another example/embodiment of a container for storing and dispensing a flowable material according to the present invention, where the container is in an open position.
Figure 14B:
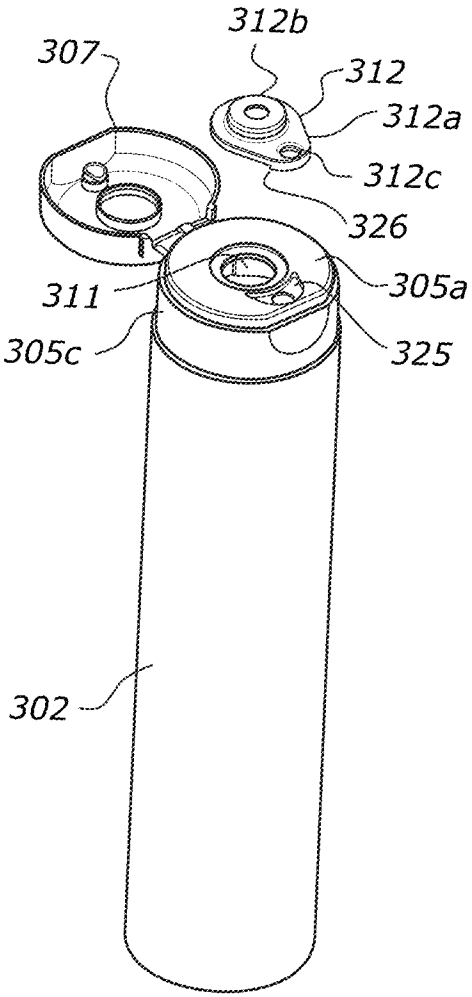
Figure 14A:
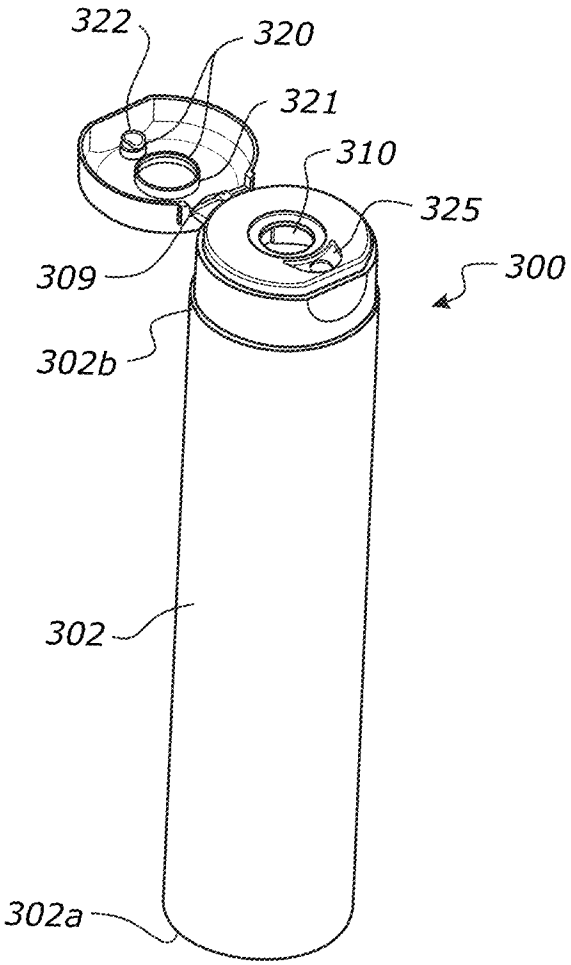
Figure 14D:
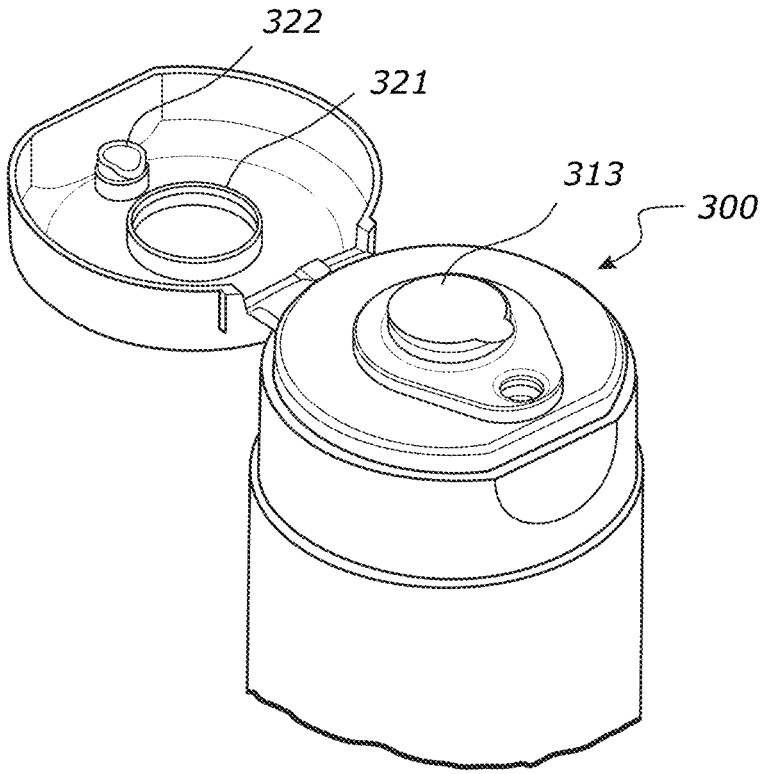
Figure 14E:
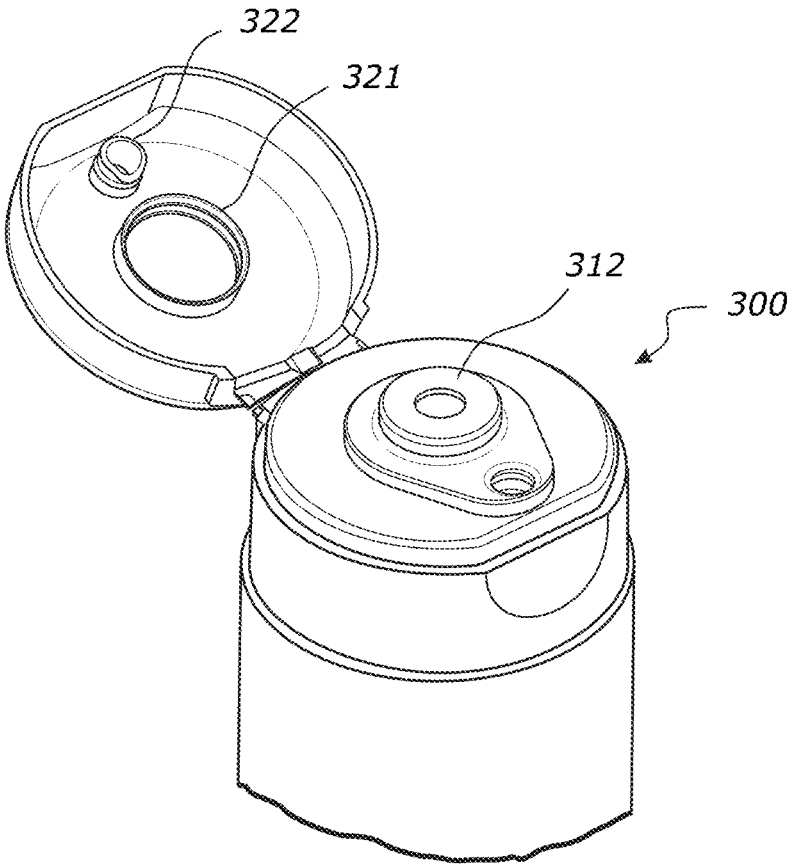

As shown in FIG. 14D, the foil 313 may be of same, similar or smaller diameter than the nipple 312*b*. In some embodiment, the foil 313 may be approximately of the same size as the orifice 314 to seal the orifice 314. The plug 312 need may plurality of orifices similar to the orifice arrangements as shown in FIGS. 8A-8D. As shown, the base 312*a* of the plug 312 may be larger than the nipple and may be shaped oval or substantially oval.

As shown the top portion 305*a* of the base portion 305 may comprise a slot 325 configured to receive a complementary protrusion 325 formed on the bottom of the base of the plug 312 to further facilitate the proper insertion and attachment of the plug to the lid and reduce risk of misalignment during the insertion and attachment process.

If the complementary feature 312*c* is a hole, another hole of a similar sized and may be formed on the cavity or slot 325 to further engage and interlock with the second engagement portion 322 in the form of pin or pintle when the lid 304 is in the closed configuration. The cavity or slot 325 may be a crescent-shaped cavity or slot and similarly, the complementary protrusion 326 formed at the bottom of the base 312*a* of the plug 326 may also be crescent-shaped.

A. Hinge Fragility Test

Figure 15:
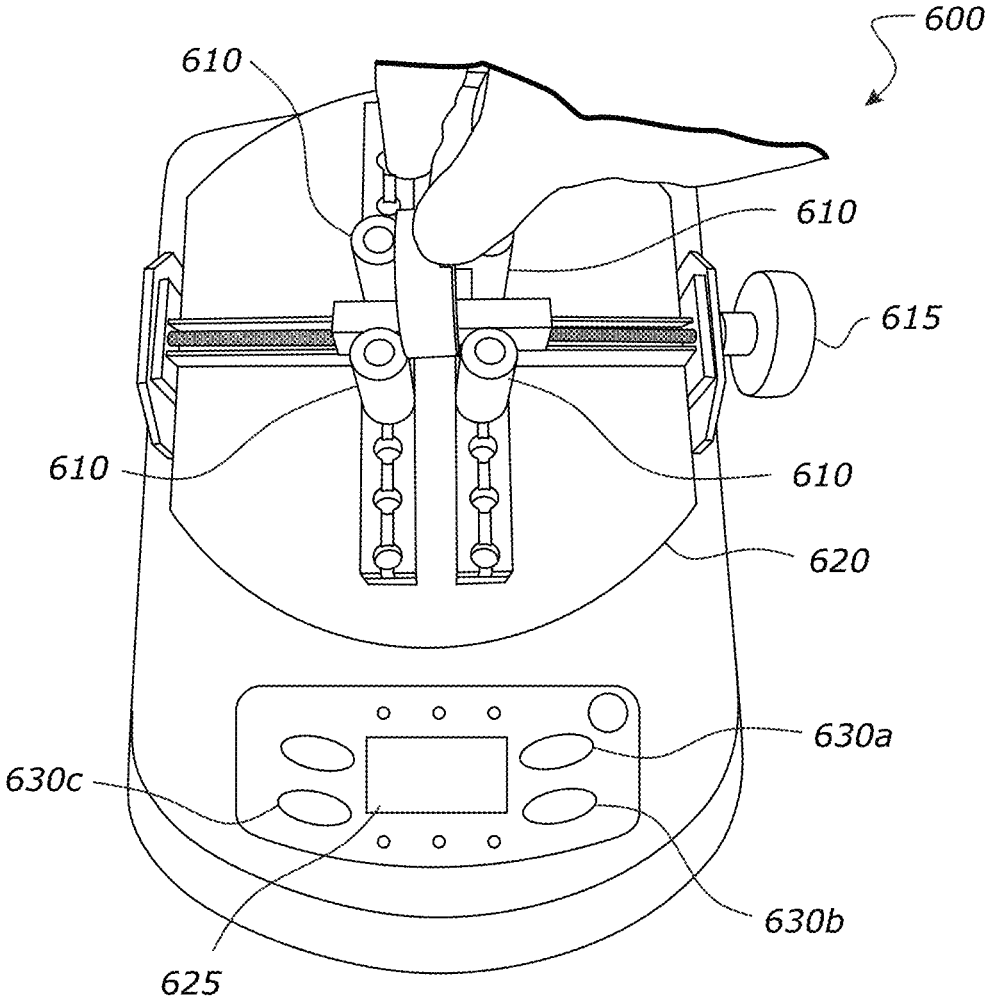
FIG. 15: shows an apparatus (test equipment) for use in hinge fragility test of the lid of the container of FIG. 1, 13A-13C, 14A-14E.

FIG. 15 shows an apparatus 600 (test equipment) for use in hinge fragility test of the lid 104, 204, 304 of the container 100, 200, 300. The apparatus 600 is a digital torque tester. The apparatus 600 comprises clamping posts 610 (preferably four clamping posts) a screw knob 615 that can be turned in a clockwise and anti-clockwise direction for clamping or unclamping an item (such as lid 104, 204, 304) to be tested using the clamping posts 610. The apparatus 600 also comprises a mounting table 620 and a display panel 625 and plurality buttons (e.g. "Power" button 630*a* for powering the apparatus on/off, "Mode" button 630*b* for changing the mode, "Zero" button 630*c* to ensure that the torque meter is zero)

The test procedure may include the following steps:

Step 1: Open the lid 104, 204, 304 of the container 100, 200, 300 to 180° and place the base portion 105, 205, 305 of the lid 104, 204, 304 between the clamping posts 610.

Step 2: Turn the screw knob 615 clockwise to clamp/hold the base portion 105, 205, 305 tightly with the clamping posts 610.

Step 3: Turn on the power of the apparatus 600 (e.g. by depressing the "Power" button 630*a*), select the measuring mode to "close" (e.g. by depressing the "Mode" button 630*b*), then calibrate the torque meter so that it is torque meter reads 0 (e.g. by depressing the "Zero" button 630*c*).

Step 4: Hold the lid 104, 204, 304 and turn the lid 104, 204, 304 clockwise until the hinge 109, 209, 309 cracks.

Step 5: Record the data indicated/displayed on the panel as the closure hinge fragility data.

Step 6: Remove the testing lid 104, 204, 304 from the clamping posts 610 by turning the screw knob 615 anti-clockwise. Turning the screw knob 615 will unclamp the lid 104, 204, 304.

By comparing the data obtained from step 5 with the threshold data, it can be determined if the lid 104, 204, 304 has passed or failed the hinge fragility test. For example, if the data (e.g. torque measurement data) obtained from Step 5 is lower than the threshold data (e.g. threshold torque measurement data) then that may indicate that the lid 104, 204, 304 that is tested has failed the hinge fragility test. Similarly, if the data (e.g. torque measurement data) obtained from Step 5 is same or higher than the threshold data (e.g. threshold torque measurement data) then that may indicate that the lid 104, 204, 304 that is tested has passed the hinge fragility test.

B. Drop Test

Figure 16:
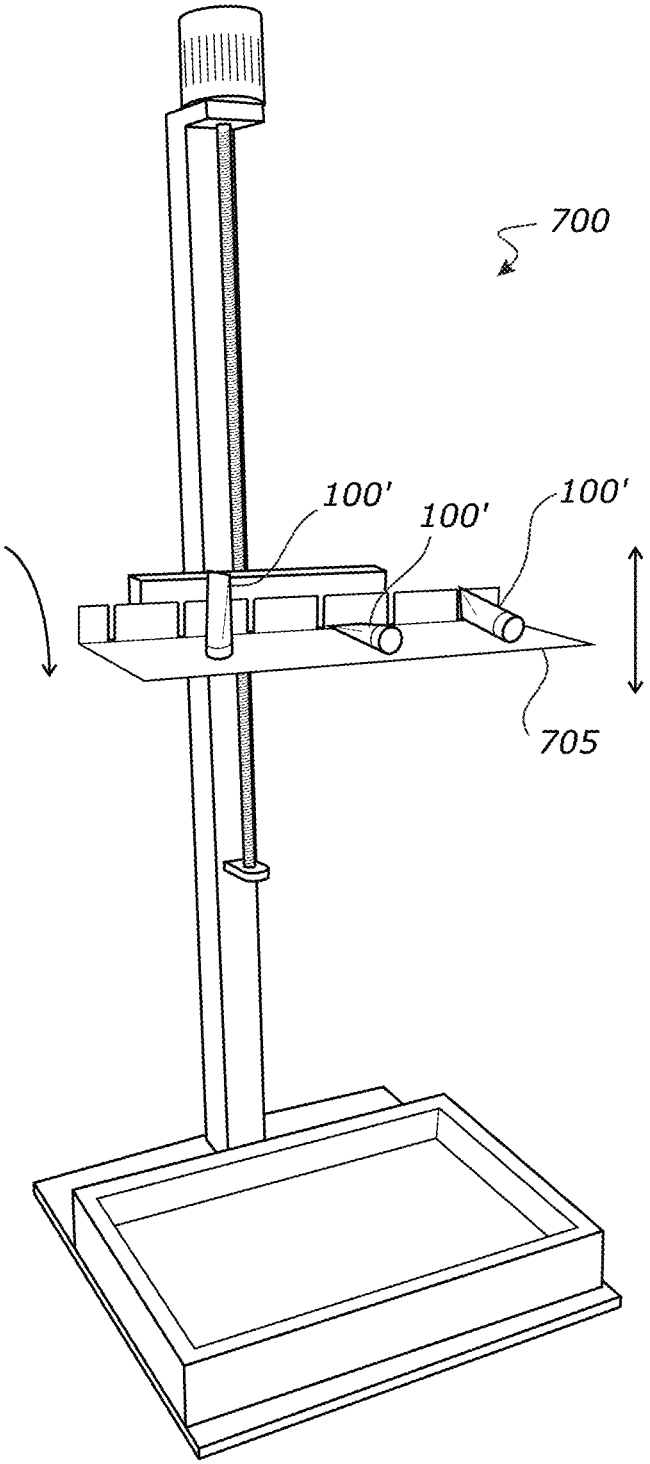
FIG. 16: shows an apparatus (test equipment) for use drop test of the container of FIGS. 11, 13A-13C, 14A-14E.

FIG. 16 shows an apparatus 700 (test equipment) for use in drop test of the lid of the container 100'. Container 100, 200, 300 as described above may equally be tested using this apparatus 700. The apparatus comprises a platform 705 the height of which can be adjusted.

The test procedure may include the following steps:

Step 1: Fill the testing container 100' with water to volume (e.g. as per tube length versus tube volume chart used in the industry)

Step 2: Adjust the height of the platform 305 to one meter from a landing surface. As an example, the landing surface may be Standard excelon vinyl composition tile surface which is about ⅛ inch in thickness)

Step 3: Oriented the container 100' onto the platform to perform 10 drops consecutively (each container 100' may be tested 10 times, i.e. in five different orientations for two cycles)

Step 4: Check if the container 100' leaks after drop and if so record the drop sequence number and deflects of the failed container.

Step 5: Record the test results on the tube drop test report.

As shown, multiple containers may be tested at the same time.

C. Laboratory Test Results of the Material Used to Make the Container:

The material used for making the container 100, 200, 300 was supplied to a laboratory in resin pellet Form.

The submitted material, consisting of resin pellets, was moulded into multipurpose test specimens and subjected to testing in accordance with the test methods outlined below, except for melt flow testing which was performed using the received resin pellets. The test specimens were conditioned for a minimum of 40 hours at 23+/− 2° C. and 50+/− 10% R.H. prior to testing. Testing was performed immediately after removal from the conditioning chamber.

1) Melt Flow Rate Test

The submitted material was tested for melt flow rate at 2010 g and 230° C. in accordance with ASTM D1238-13, Procedure A.

Results 80.3, 84.2 g/10 Minutes; Average=82.1 g/10 minutes

2) Density Test

Three test specimens were tested for density in accordance with ASTM D792-13, Method A.

Results:

TABLE 2

| Specimen | Density, g/cm$^3$ |
|---|---|
| 1 | 0.897 |
| 2 | 0.896 |
| 3 | 0.897 |
| Average | 0.897 |

3) Tensile test

The moulded tensile specimens were subjected to tensile testing in accordance with ASTM D638-14. The specimens were ASTM D638-14 Type I test specimens. Nominal thickness of the test specimens was 3.02 mm. Tensile testing was performed with a test speed of 500 mm/minute with a 115 mm distance between the grips.

Results:

TABLE 3

| Specimen | Tensile Strength at Yield (MPa) | Tensile Strength at Break (MPa) | Elongation at Yield in 50 mm (%) | Nominal Strain at Break (%) |
|---|---|---|---|---|
| 1 | 19.1 | 13.4 | 10.8 | 113 |
| 2 | 18.6 | 13.7 | 10.6 | 70.0 |
| 3 | 18.9 | 13.7 | 10.8 | 129 |
| 4 | 18.2 | 13.1 | 10.8 | 59.1 |
| 5 | 18.2 | 13.4 | 11.1 | 74.3 |
| Average | 18.6 | 13.5 | 10.8 | 89.1 |

4) Flexural Test

The moulded test specimens were subjected to a flexural test in accordance with ASTM D790-10, Procedure A.

Test Parameters:

TABLE 4

| | |
|---|---|
| Direction of Specimen Cutting: Moulded | Support Span Length: 49.6 mm |
| Direction of Specimen Loading: Flatwise | Radius of Supports and Loading Nose: 5 mm |
| Support Span to Depth Ratio: 16:1 | Rate of Crosshead Motion: 1.32 mm/minute |

Results:

TABLE 5

| Specimen | Width (mm) | Depth (mm) | Flexural Tangent Modulus (MPa) | Flexural Strength @ 5% Strain (MPa) |
|---|---|---|---|---|
| 1 | 12.75 | 3.11 | 439 | 15.2 |
| 2 | 12.76 | 3.11 | 429 | 15.0 |
| 3 | 12.78 | 3.09 | 422 | 15.2 |
| 4 | 12.73 | 3.10 | 429 | 15.2 |
| 5 | 12.79 | 3.08 | 444 | 15.4 |
| 3 | 12.76 | 3.10 | 433 | 15.2 |

Maximum Strain: 5%; Type of Behaviour: Yielding

5) Izod Impact Test

Ten specimens were cut to the required length from the moulded multipurpose specimens, notched and subjected to Izod Impact testing in accordance with ASTM D256-10 (Reapproved 2018), Method A using a 2 ft.lbf (2.7) pendulum. Five test specimens were tested at room temperature and five test specimens were tested at −20° C.

Results:

TABLE 6

| At Room Temperature | | | | |
|---|---|---|---|---|
| Specimen | Depth Under Notch (mm) | Width Along Notch (mm) | Impact Resistance (J/m) | Type of Failure |
| 1 | 10.12 | 3.10 | 145 | Complete Break |
| 2 | 10.18 | 3.10 | 147 | Complete Break |
| 3 | 10.14 | 3.10 | 210 | Complete Break |
| 4 | 10.21 | 3.10 | 174 | Complete Break |
| 5 | 10.15 | 3.10 | 149 | Complete Break |
| | | | Average = 165 J/m | |

TABLE 7

| At −20° C. | | | | |
|---|---|---|---|---|
| Specimen | Depth Under Notch (mm) | Width Along Notch (mm) | Impact Resistance (J/m) | Type of Failure |
| 1 | 10.15 | 3.10 | 47.3 | Complete Break |
| 2 | 10.21 | 3.10 | 42.3 | Complete Break |
| 3 | 10.21 | 3.10 | 39.0 | Complete Break |
| 4 | 10.20 | 3.10 | 41.4 | Complete Break |
| 5 | 10.19 | 3.10 | 40.6 | Complete Break |
| | | | Average = 42.1 J/m | |

Some of the features of the material used to make the container 100 include:

Medium Flow specialty Thermoplastic Polyolefin

Designed For thin wall injection moulding

Injection moulded Tube application with enhanced toughness

Enhanced Sealing strength

Enhanced Low Temperature Impact

Good Moisture/Chemical Resistance

Where in the foregoing description reference has been made to elements or integers having known equivalents, then such equivalents are included as if they were individually set forth.

Unless otherwise explicitly mentioned, the container of the present invention is not limited to a miniature container for storing toiletries or similar material (product) and could be any container for storing any dispensing any flowable material (product) that is within the scope of the claims. Similarly, unless other explicitly mentioned, the container of the present invention is not to be limited to any specific size and/or shape.

Although the invention has been described by way of example and with reference to particular embodiments, it is to be understood that modifications and/or improvements may be made without departing from the scope or spirit of the invention.

In addition, where features or aspects of the invention are described in terms of Markush groups, those skilled in the art will recognise that the invention is also thereby described in terms of any individual member or subgroup of members of the Markush group.

The invention claimed is:

1. A container in the form of an In-Mold Labelled (IML) Tube for storing and dispensing a flowable material, the container comprising:

a housing that is hollow with a closed end, the housing being configured to store at least one flowable material that is to be dispensed from the container; and a lid that is configured to be integrally formed with the housing, the lid comprising a base portion and a cap portion, the cap portion being pivotably mounted to the base portion by a hinge that is a part of the lid;

wherein, the base portion of the lid comprises a sealing member in the form of a plug that is or is configured to be inserted and attached to the lid to at least partially or fully seal an aperture formed at the base portion of the lid, at least one orifice is formed or configured to be formed on the plug and functions as an egress opening through which at least one flowable material is configured to be dispensed, the lid being configured to transition between an open position and a closed position, wherein in the open position the cap portion of the lid is configured to move away from the base portion thereby revealing the egress opening, and when in the closed position the cap portion of the lid is configured to move towards the base position thereby concealing the egress opening, and the housing and the lid are made as a single piece by single injection moulding process, the rigidity of the plug being higher than the rigidity of each of the lid and the housing.

2. The container as claimed in claim 1, wherein the cap portion comprises a plug engagement portion that is configured to engage and interlock with the plug when the lid is in the closed position thereby allowing the lid to be securely locked into the closed position.

3. The container as claimed in claim 2, wherein the plug engagement portion is configured to engage and interlock with the plug when the lid is in the closed position while the at least one orifice is clear from engagement with the plug engagement portion.

4. The container as claimed in claim 2, wherein the plug engagement portion and the plug are configured to be engaged together and interlock with each other with a snap fit or snug fit arrangement.

5. The container as claimed in claim 2, wherein the plug engagement portion comprises a plug engagement member in the form of a circular rim and the plug comprises a complementary feature in the form of a nipple that is adapted to interlock with the circular rim.

6. The container as claimed in claim 2, wherein the plug engagement portion in is in the form of a first plug engagement member and a second plug engagement member which along with their respective centre points are spaced apart from one another, wherein the first and second plug engagement members are configured to engage and interlock respectively with a first complementary feature and a second complementary feature formed on the plug when the lid is in the closed position, wherein the first complementary feature and the second complementary feature and respective centre points of the first and second complementary features are spaced apart from one another.

7. The container as claimed in claim 6, wherein the first plug engagement member is in the form of a circular rim and the first complementary feature is in the form of a nipple on which the at least one orifice is formed or configured to be formed.

8. The container as claimed in claim 6, wherein the second plug engagement member is in the form of a pin that is configured to be received by the second complementary feature that is in the form of a recess or a hole.

9. The container as claimed in claim 5, wherein the plug comprises a base that is configured to be attached to the lid to seal the aperture, wherein the nipple protrudes upwardly from the base.

10. The container as claimed in claim 1, wherein at least the housing is squeezable by a user's hand and is non-fragile when such squeezing force is applied.

11. The container as claimed in claim 1, wherein the housing and the lid are made of a construction material that is or comprises at least one of polyolefin, thermoplastic polyolefin and polypropylene.

12. The container as claimed in claim 1, wherein the housing and the lid are made of same construction material of same chemical formulation.

13. The container as claimed in claim 1, wherein the container is a single use container.

14. The container as claimed in claim 1, wherein the housing is substantially tubular in shape with a substantially uniform cross-sectional area/diameter throughout the length of the housing and the housing being configured to extend between a first end and a second end along a longitudinal axis of the container, the first end being the closed end and the lid is integrally formed with the housing at the second end of the housing.

15. The container as claimed in claim 5, wherein the housing is substantially annular in cross-section in a plane that is orthogonal to the longitudinal axis of the container.

16. The container as claimed in claim 1, wherein the lid is substantially annular in cross-section in a plane that is orthogonal to the longitudinal axis of the container.

17. The container as claimed in claim 1, wherein the closed end is shaped to allow the container to stand vertically on a substantially horizontal surface.

18. The container as claimed in claim 1, wherein the at least one orifice and/or the aperture is sealed by at least one foil.

* * * * *